US006186115B1

(12) United States Patent
Nishimura et al.

(10) Patent No.: US 6,186,115 B1
(45) Date of Patent: Feb. 13, 2001

(54) THROTTLE VALVE CONTROL DEVICE FOR AN INTERNAL COMBUSTION ENGINE

(75) Inventors: Mitsunori Nishimura, Hitachinaka; Hidefumi Adachi, Mito; Yoshikatsu Hashimoto, Hitachiohta, all of (JP)

(73) Assignee: Hitachi, Ltd. (JP)

( * ) Notice: Under 35 U.S.C. 154(b), the term of this patent shall be extended for 0 days.

(21) Appl. No.: 09/077,998

(22) PCT Filed: Aug. 26, 1996

(86) PCT No.: PCT/JP96/02375

§ 371 Date: Jun. 15, 1998

§ 102(e) Date: Jun. 15, 1998

(87) PCT Pub. No.: WO97/22787

PCT Pub. Date: Jun. 26, 1997

(30) Foreign Application Priority Data

Dec. 19, 1995 (JP) ..... 7-330081

(51) Int. Cl.[7] ..... F02D 9/10

(52) U.S. Cl. ..... 123/337; 123/339.25; 123/399; 251/305

(58) Field of Search ..... 123/339.25, 339.26, 123/337, 361, 399; 251/305; 261/65

(56) References Cited

U.S. PATENT DOCUMENTS 4,474,150 * 10/1984 Foley et al. ..... 123/337
5,315,975 * 5/1994 Hattori et al. ..... 123/337
5,465,696 * 11/1995 Gmelin ..... 123/337
5,615,861 * 4/1997 Pollmann et al. ..... 123/403 X
5,669,350 * 9/1997 Altmann et al. ..... 123/337
5,722,366 * 3/1998 Adachi et al. ..... 123/337
5,749,336 * 5/1998 Tamaki et al. ..... 123/337

FOREIGN PATENT DOCUMENTS 7-269377 * 10/1995 (JP) .

* cited by examiner

*Primary Examiner*—Tony M. Argenbright
(74) *Attorney, Agent, or Firm*—Evenson, McKeown, Edwards & Lenahan, P.L.L.C.

(57) ABSTRACT

A throttle valve is rotatably mounted to a throttle body through a throttle shaft. An internal bore shape of the throttle body is of a straight bore type having a shape in which the center of rotation of the throttle valve is placed on the central line of the throttle body. Spherically-shaped internal profile portions are provided in an idle control region lying in the neighborhood of a fully-closed angle of the throttle valve. Further, spherically-shaped internal profile portions are provided as regions following the spherically-shaped internal profile portions referred to above. Moreover, regions each formed by a spherical shape and a composite surface profile of a cylindrical surface substantially parallel to the flow of intake air or regions each formed by a conical surface profile are provided as regions following the spherically-shaped profiles. Incidentally, the center of each spherical profile is offset on the central line of the bore in upward and downward directions. As a result, a clearance defined between each spherical profile and the throttle valve increases as the degree of opening of the throttle valve increases. When the present invention is used in an electronically-controlled type throttle valve control device, the engine speed is set so as to be changed 20 rpm when the throttle valve is opened 0.1° in a low degree-of-opening region of the throttle valve. Therefore, idle control exercised by an ISC valve is unnecessary.

13 Claims, 21 Drawing Sheets

THROTTLE VALVE CONTROL DEVICE FOR AN INTERNAL COMBUSTION ENGINE

TECHNICAL FIELD

The present invention relates to a throttle valve control device for an internal combustion engine, and particularly to a throttle valve control device for an internal combustion engine, which is suitable for use in a throttle valve control device of an electronically-controlled throttle type.

BACKGROUND ART

A so-called throttle valve control device of an electronically-controlled throttle type, which in order to control the degree of opening of a throttle valve for a vehicle internal combustion engine, takes in or senses the amount of depression of an accelerator pedal as an electric signal by a detector (sensor), performs arithmetic processing on it, supplies the so-processed signal to an actuator comprised of a motor or the like and controls the opening and closing of the throttle valve by the actuator, is known in Japanese Patent Applicaticn Laid-Open No. 62-284932 or the like.

There has been a demand for a throttle valve control device allowing only this type of electronically-controlled throttle valve to perform all inclusive of air quantity control, such as ISC (Idle Speed Control), FIC (First Idle Control) in a region in which an intake air flow rate is less.

With a view toward allowing control of small or thin intake air quantity, it is necessary to allow the rate of change in air passage sectional area between the throttle valve and a wall surface of a intake pipe to finely vary with satisfactory accuracy according to a change in the degree of opening of the throttle valve as well as to improve the accuracy of control of the actuator itself to thereby permit fine control on the degree of opening of the throttle valve.

In regard to this point of view, as has been described in Japanese Patent Application Laid-Open Nos. 5-296067, 3-11133 and 3-15631 or Japanese Patent Application Laid-Open No. 56-56938 or the like, it is considered that some thought or ideas are put into profiles of a bore inner wall surface of an intake pipe opposed to a disc-shaped throttle valve, and the rate of changes in passage sectional area between the throttle valve and the wall surface with respect to a change in the degree of opening of the throttle valve is set so as to be able to be finely controlled in a low degree-of-opening region (FIC or ISC region) of the throttle valve.

An object of the present invention is to provide a novel throttle valve control device of capable of meeting the above-described demands on the electronically-controlled type throttle valve control device. However, this can be used when a like characteristic (e.g., generally called "delayed-opening characteristic") is required even in the case of a non-electronically-controlled type throttle valve control device.

DISCLOSURE OF INVENTION

In order to achieve the above object, the present invention provides a throttle valve control device for an internal combustion engine, comprising a throttle valve rotatably mounted to a throttle body having a bore which is defined so that the center of rotation of the throttle valve is placed on a line connecting the center of an opening on the upstream side of the throttle body and the center of an opening on the downstream side thereof, and which has curved-surface profiles each spherical or closely analogous to a spherical form, which are provided on at least one of the upstream and downstream sides of the throttle valve in an idle control region lying in the vicinity of a fully-closed angle of the throttle valve. In the throttle valve control device, the bore of the throttle body has curved-surface profiles or conical surface profiles substantially parallel to the flow of intake air, which follow the curved-surface profiles spherical or closely analogous to the spherical form. Such a construction can provide matching to an electronically-controlled system and improve the accuracy of measurement in the ISC and FIC regions and controllability on an air flow rate.

In the throttle valve control device for the internal combustion engine, the curved-surface profiles substantially parallel to the flow of the intake air are preferably formed as cylindrical surface profiles.

In the throttle valve control device for the internal combustion engine, preferably, regions for the curved-surface profiles each spherical or closely analogous to the spherical form are formed on the upstream and downstream sides of the throttle valve, and at least one thereof is formed from a curved-surface profile or conical surface profile substantially parallel to the flow of intake air, following the curved-surface profiles and a composite surface profile.

In the throttle valve control device for the internal combustion engine, preferably, the regions for the curved-surface profiles spherical or closely analogous to the spherical form and regions each consisting of a composite surface profile of a curved-surface profile spherical or closely analogous to a spherical form and a curved-surface profile or conical surface profile substantially parallel to the flow of the intake air, following the curved-surface profile referred to above, are provided on one of the upstream and downstream sides of the throttle valve, whereas a conical surface profile is provided on the other of the upstream and downstream sides of the throttle valve.

The object of the present invention can be achieved even by constructing a degree-of-opening signal indicative of the actual degree of opening of the throttle valve in such a manner that the rate of change in the signal with respect to the same angular change becomes greater than in middle and high degree-of-opening regions in a predetermined degree-of-opening region of the throttle valve and constructing an inner peripheral wall surface profile of the throttle body so as to have a degree-of-opening—air quantity change rate characteristic allowing control on an air flow rate equivalent to a change in engine speed of 20 rpm/min in the predetermined low degree-of-opening region thereof.

Further, the above object of the present invention can be achieved by constructing the regions for the curved-surface profiles spherical or closely analogous to the spherical form and constructing the wall surface profile on at least one of the upstream and downstream sides of the throttle valve so as to comprise a composite surface profile of a conical surface profile following a curved-surface profile spherical or closely analogous to a spherical form and a cylindrical surface profile following the conical surface profile.

Further, in order to achieve the above object, the present invention provides a throttle valve control device for an internal combustion engine, comprising a throttle valve rotatably mounted to a throttle body and an actuator for rotating the throttle valve and wherein the throttle body has a bore defined therein including such a shape that the center of rotation of the throttles valve is located on a line connecting the center of an opening on the upstream side of the throttle body and the center of an opening on the downstream side thereof, and curved-surface profiles each spherical or closely analogous to a spherical form in the idle control region lying in the vicinity of the fully-closed angle of the throttle valve and both regions on the upstream and downstream sides of the throttle valve. In the throttle valve control device for the internal combustion engine, the position of the center of each curved-surface profile corresponds to a position deviated by a predetermined amount from the center of rotation of the throttle valve. The bore of the throttle body has regions each consisting of a curved-surface profile spherical or closely analogous to a spherical form and a composite surface profile of a surface substantially parallel to the flow of intake air, following the curved-surface profile, as regions following the curved-surface profiles spherical or closely analogous to the spherical form.

Moreover, in order to achieve the above object, the present invention provides a throttle valve control device for an internal combustion engine, comprising a throttle valve rotatably mounted to a throttle body and an actuator for rotating the throttle valve and wherein the throttle body has a bore defined therein including such a shape that the center of rotation of the throttle valve is placed on a line connecting the center of an opening on the upstream side of the throttle body and the center of an opening on the downstream side thereof, curved-surface profiles each spherical or closely analogous to a spherical form in an idle control region lying in the vicinity of a fully-closed angle of the throttle valve and a region downstream the throttle valve, and conical surface shapes in the idle control region lying in the vicinity of the fully-closed angle of the throttle valve and a region upstream the throttle valve. In the throttle valve control device for the internal combustion engine, the position of the center of each curve-surface shape referred to above coincides with the center of rotation of the throttle valve and the bore of the throttle body has regions each comprising a curved-surface profile spherical or closely analogous to a spherical form and a composite surface profile of a surface substantially parallel to the flow of intake air, as regions following the curved-surface profiles spherical or closely analogous to the spherical form.

In order to achieve the above object, the present invention provides a throttle valve control device for an internal combustion engine, comprising a throttle valve rotatably mounted to a throttle body and an actuator for rotating the throttle valve and wherein the throttle body has a bore defined therein having such a shape that the center of rotation of the throttle valve is placed on a line connecting the center of an opening on the upstream side of the throttle body and the center of an opening on the downstream side thereof. In the throttle valve control device for the internal combustion engine, the bore of the throttle body has conical surface profiles in an idle control region lying in the vicinity of a fully-closed angle of the throttle valve and either one of regions on the upstream and downstream sides of the throttle valve, and curved-surface profiles each spherical or closely analogous to a spherical form in the idle control region lying in the vicinity of the fully-closed angle of the throttle valve and the other thereof on the remaining one side of the throttle valve. The position of the center of each curved-surface profile corresponds to a position deviated by a predetermined amount toward the upstream or downstream side from the center of rotation of the throttle valve. Further, the bore has regions each comprising a curved-surface profile substantially parallel to the flow of intake air, as regions following the curved-surface profiles spherical or closely analogous to the spherical form.

In order to achieve the above object, the present invention provides a throttle valve control device for an internal combustion engine, comprising a throttle valve rotatably mounted to a throttle body and an actuator for rotating the throttle valve and wherein the throttle body has a bore defined therein including such a shape that the central axis of rotation of the throttle valve is orthogonal to a line connecting the center of an opening on the upstream side of the throttle body and the center of an opening on the downstream side thereof. In the throttle valve control device for the internal combustion engine, a profile of a part of the bore of the throttle body in an idle control region lying in the vicinity of a fully-closed angle of the throttle valve is defined as an elliptic shape surrounded by two circular arcs.

In order to achieve the above object, the present invention provides a throttle valve control device for an internal combustion engine, comprising a throttle valve rotatably mounted to a throttle body, an actuator for rotating the throttle valve, throttle degree-of-opening detecting means for detecting the degree of opening of the throttle valve rotated by the actuator, and control means for controlling the actuator based on the amount of depression of an accelerator detected by the accelerator degree-of-opening detecting means so that the detected degree of opening of the throttle valve reaches a predetermined value, and wherein the throttle body has a bore defined therein including such a shape that the center of rotation of the throttle valve is placed on a line connecting the center of an opening on the upstream side of the throttle body and the center of an opening on the downstream side thereof, and curved-surface shapes each spherical or closely analogous to a spherical form in an idle control region lying in the vicinity of a fully-closed angle of the throttle valve. In the throttle valve control device for the internal combustion engine, the bore of the throttle body has regions each comprising a curved-surface shape spherical or closely analogous to a spherical form and a composite surface shape of a surface substantially parallel to the flow of intake air, as regions following the curved-surface shapes spherical or closely analogous to the spherical form.

BEST MODE FOR CARRYING OUT THE INVENTION

A throttle valve control device for an internal combustion engine, according to one embodiment of the present invention will hereinafter be described with reference to FIGS. 1 through 5.

Figure 1:
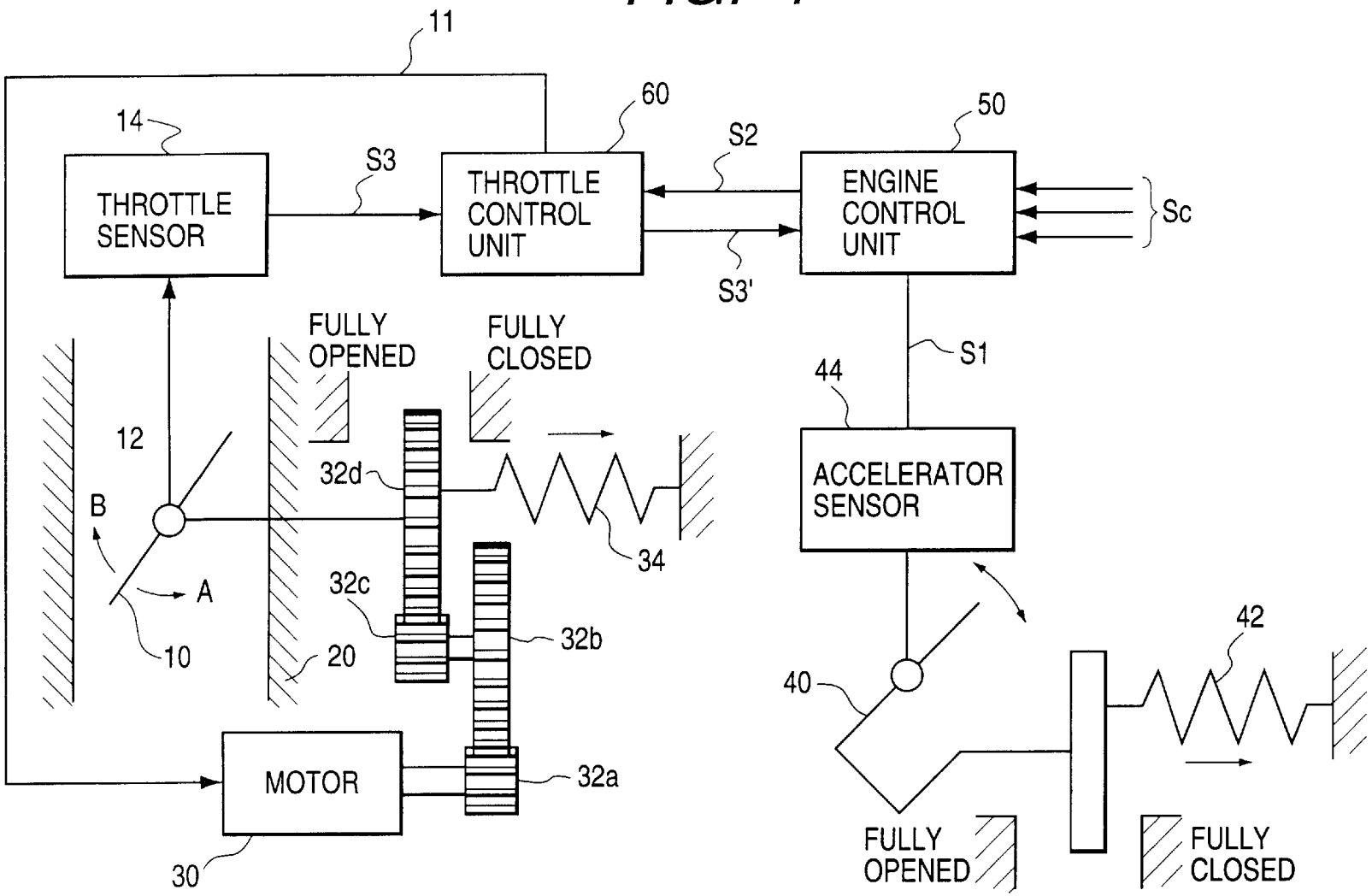
FIG. 1 is a view showing the structure of a throttle valve control device for an internal combustion engine, according to one embodiment of the present invention.

FIG. 1 is a view showing the structure of a throttle valve control device for an internal combustion engine, according to one embodiment of the present invention.

A throttle valve 10 is fixed to a throttle shaft 12. The throttle shaft 12 is rotatably supported by a throttle body 20. A reduction gear 32*a* is fixed to an output shaft of a motor 30, which serves as an actuator for the control of the degree of opening of the throttle valve 10. A reduction gear 32*b* meshes with the reduction gear 32*a*. The reduction gear 32*b* is coupled to a reduction gear 32*c* and the reduction gear 32*c* is maintained in meshing engagement with a reduction gear 32*d*. The reduction gear 32*d* is coupled to the throttle shaft 12. Thus, when the motor 30 is rotated, its rotating force is transferred through the reduction gears 32*a*, 32*b*, 32*c* and 32*d* to turn the throttle valve 10 in the direction indicated by arrow A, i.e., in the direction to open the throttle valve 10. Further, the reduction gear 32*d* is supplied with an urging force by a return spring 34, by which torque is applied to the throttle valve 10 in the direction indicated by arrow B, i.e., in a throttle-valve closing direction.

An accelerator pedal 40 is urged in the closing direction of the accelerator pedal 40 by an accelerator return spring 42. When a driver depresses the accelerator pedal 40, the amount of depression thereof is detected by an accelerator sensor 44. An accelerator degree-of-opening signal S1 corresponding to the output of the accelerator sensor 44 is captured by an engine control unit 50. Engine driving information Sc such as the number of revolutions of an engine, i.e., an engine speed, the quantity of air introduced into the engine, the water temperature of the engine, etc. is brought to the engine control unit 50. The engine control unit 50 performs a computation on the basis of the accelerator degree-of-opening signal S1 and the engine driving information Sc and thereby outputs a target degree-of-opening-of-throttle signal S2 to a throttle control unit 60.

The throttle control unit 60 outputs a current I1 for driving the motor 30 therefrom in response to the target degree-of-opening-of-throttle signal S2. The motor 30 is rotated according to the drive current I1 and the resultant rotating force is transferred to the throttle shaft 12 through the reduction gears 32*a*, 32*b*, 32*c* and 32*d* so as to turn the throttle valve 10. An opening angle of the throttle valve 10 is detected by ct throttle sensor 14. An actual degree-of-opening-of-throttle signal S3 corresponding to the output of the throttle sensor 14 is captured by the throttle control unit 60. The throttle control unit 60 feedback-controls the motor drive current I1 so that the actual degree-of-opening-of-throttle signal S3 becomes equal to the target degree-of-opening-of-throttle signal S2. The throttle control unit 60 outputs the actual degree-of-opening-of-throttle signal S3 to the engine control unit 50 as an actual degree-of-opening-of-throttle signal S3'.

As described above, the engine control unit 50 and the throttle control unit 60 can control the degree of opening of the throttle valve 10 according to the amount of depression of the accelerator pedal 40 and is also capable of controlling the degree of opening of the throttle valve 10 according to the driven state of the engine regardless of the depression of the accelerator pedal 40.

Figure 2:
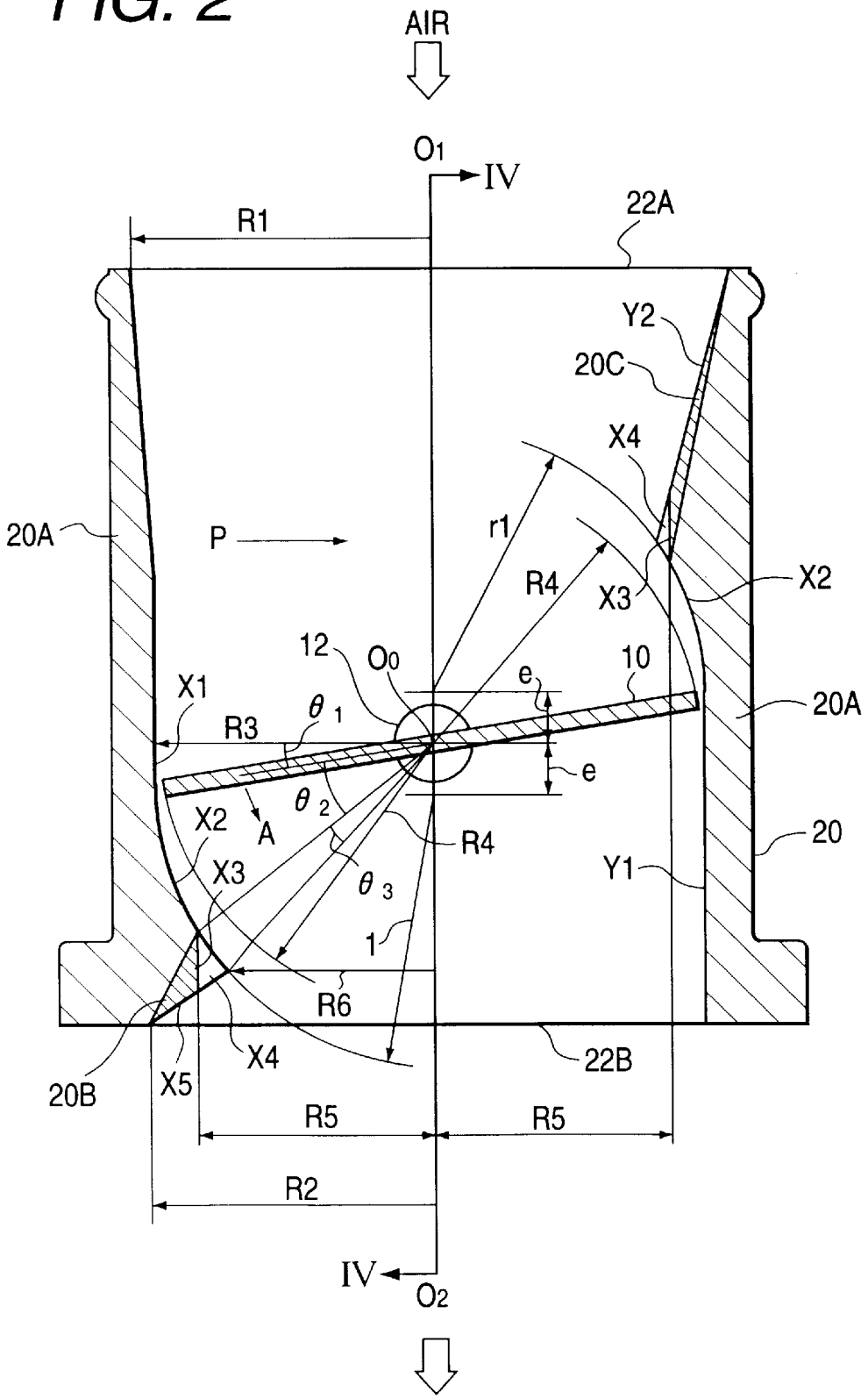
FIG. 2 is a cross-sectional view of a throttle body of the throttle valve control device for the internal combustion engine shown in FIG. 1 and is a cross-sectional view taken along line II—II of FIG. 4.

FIG. 2 is a cross-sectional view showing the throttle body of the throttle valve control device for the internal combustion engine, according to the one embodiment of the present invention.

The throttle valve 10 is fixed to the throttle body 12. The throttle shaft 12 is rotatable supported by the throttle body 20. In the illustrated state, the throttle valve 10 is in a fully-closed state. The throttle valve 10 is turned about a point O0 in the direction indicated by arrow A. When the throttle valve 10 coincides with a line connecting points O1-O0-O2 to each other, the throttle valve 10 is opened to the maximum. The degree of opening of the throttle valve 10 is a type of 90 degrees or less.

Intake air is introduced from an opening 22A defined above the throttle body 20 and is discharged through an opening 22B defined below the throttle body 20. The upper opening 22A of the throttle body 20 is circular with the line connecting the points O1-O0-O2 to each other as the center and the radius thereof is given by R1. The lower opening 22B of the throttle body 20 is also circular with the line connecting the points O1-O0-O2 to each other as the center and the radius thereof is given by R2. The shape of a surface orthogonal to the line connecting the points O1-O0-O2 to each other is circular and the radius thereof is given by R3.

Namely, the throttle body 20 is basically of a straight bore type wherein the shape of the upper opening 22A, the shape of the throttle valve 10 and the shape of the lower opening 22B are respectively circular and the Renters of their circular shapes are placed on the straight line connecting the points O1-O0-O2 to each other.

In the cross-sectional state illustrated in the drawing, the throttle body 20 comprises a base portion 20A used as a principal structural body, a composite surface portion 20B formed by a spherical surface and a cylindrical surface provided on the downstream side of the base portion 20A, and a composite surface portion 20C formed by a spherical surface and a cylindrical surface provided on the upstream side of the base portion 20A. Now, the base portion 20A, the composite surface portion 20B and the composite surface portion 20C are integrally formed by a die cast process but are shown as distinguished from each other for description of the embodiment. Further, the composite surface portion 20B and the composite surface portion 20C are used as surfaces newly added to the conventional throttle body having only the spherical bore in the above one embodiment of the present invention.

The shape of an inner surface of the throttle body 20 will next be explained. The shape of the inner surface thereof is formed symmetrically with respect to the upstream and downstream sides of the center O0 of rotation of the throttle valve 10. As described above, the illustrated state indicates that the throttle valve 10 is in the fully-closed state. However, the throttle valve 10 is inclined only an angle θ1 toward a line orthogonal to the line joining the points O1-O0-O2 to each other as seen from the center O0 of the throttle valve 10. This angle θ1 will be referred to as "fully-closed angle". An inner surface X1 of the throttle body 20 is shaped in the form of a cylinder having a radius of R3 within the range of the fully-closed angle θ1.

Next, the throttle valve 10 is turned in the direction indicated by arrow A and hence an inner surface X2 lying within the range of the angle θ2 is shaped in the form of a spherical surface. The center of the spherical surface is shaped into a spherical surface of a radius r1 with positions shifted by displacements or deviations e from the center O0 of rotation of the throttle valve 10 to the downstream and upstream sides thereof respectively as the centers. At this time, the radius of the throttle valve 10 is given by R4 and an open or aperture area, i.e., an air passage area formed between the throttle valve 10 and the inner surface X2 takes a shape which gradually increases as the throttle valve 10 rotates, as is apparent from the difference between the locus of the radius R4 and the locus of the spherical surface of the radius r1. Since the deviation e is equivalent to the slight amount of displacement, a change in the aperture area with respect to a change in the degree of opening of the throttle valve 10 is designed so as to decrease. The region of the angle θ2 serves as an idle control region, which is a region for controlling the number of revolutions at idle and various loads such as an air conditioner load, a power steering load, an automatic transmission load, etc. by an electronic control throttle. Since a number-of-revolutions control accuracy corresponding to a high accuracy of about ±20 rpm is required in such an idle control region, the throttle body is shaped in the form of a spherical bore so as to reduce the change in the open area with respect to the change in the degree of opening of the throttle valve 10.

Next, an inner surface X3 subsequent to the inner surface X2 having the spherical shape is represented in a composite form of a spherical surface and a cylindrical surface. Namely, the inner surface X3 is shaped in the form of a spherical surface by further extending the spherical surface of the radius r1 by an angle θ3 and is thereafter brought into a shape cut tc a cylindrical shape of a radius R5 with respect to the line connecting the points O1-O0-O2 to each other. Thus, the inner surface X3 results in the composite shape of the spherical surface and the cylindrical surface. Namely, the boundary surface between the inner surface X2 and inner surface X3 shaped into the spherical forms is spherical but includes spherical elements reduced and cylindrical surface elements increased as the throttle valve 10 turns in the direction indicated by arrow A. Although the cylindrical linear surface is shown in the illustrated state, a region X4 includes a region formed as a cylindrical part and a region in which a part of the spherical portion remains when the region X4 is seen within the plane orthogonal to the line connecting the points O1-O0-O2 to each other. This shape will be described later using FIG. 3. Thus, an aperture area, i.e., an air passage area formed between the throttle valve 10 and the inner surface X3 takes a shape which gradually increases as the throttle valve 10 is turned. At this time, a change in the aperture area with respect to a change in the degree of opening of the throttle valve 10 is designed so as to become greater than the change in the aperture area with respect to the change in the degree of opening of the throttle valve 10 in the region of the inner surface X2 represented in the spherical form.

Since the composite surface portion 20B and the composite surface portion 20C are not provided in the prior art, the change in the aperture area with respect to the change in the degree of opening of the throttle valve 10 abruptly increases when the throttle valve 10 is turned to the angle θ2 or above, so that a abrupt change in the air flow rate with respect to the degree of opening of the throttle valve 10, a so-called stepwise flow-rate change is produced. In the present embodiment, however, such an abrupt change in the air flow rate is no longer produced.

Incidentally, the throttle body 20 is manufactured by the die cast process as described above. The composite surface portion 20B and the composite surface portion 20C can be formed by processing the range of the angle θ2+θ3 into the spherical shape and cutting it to the cylindrical shape of the radius R5 upon manufacturing a die casting die.

The shape of the inner surface X3 will now be described using FIG. 3.

Figure 3:
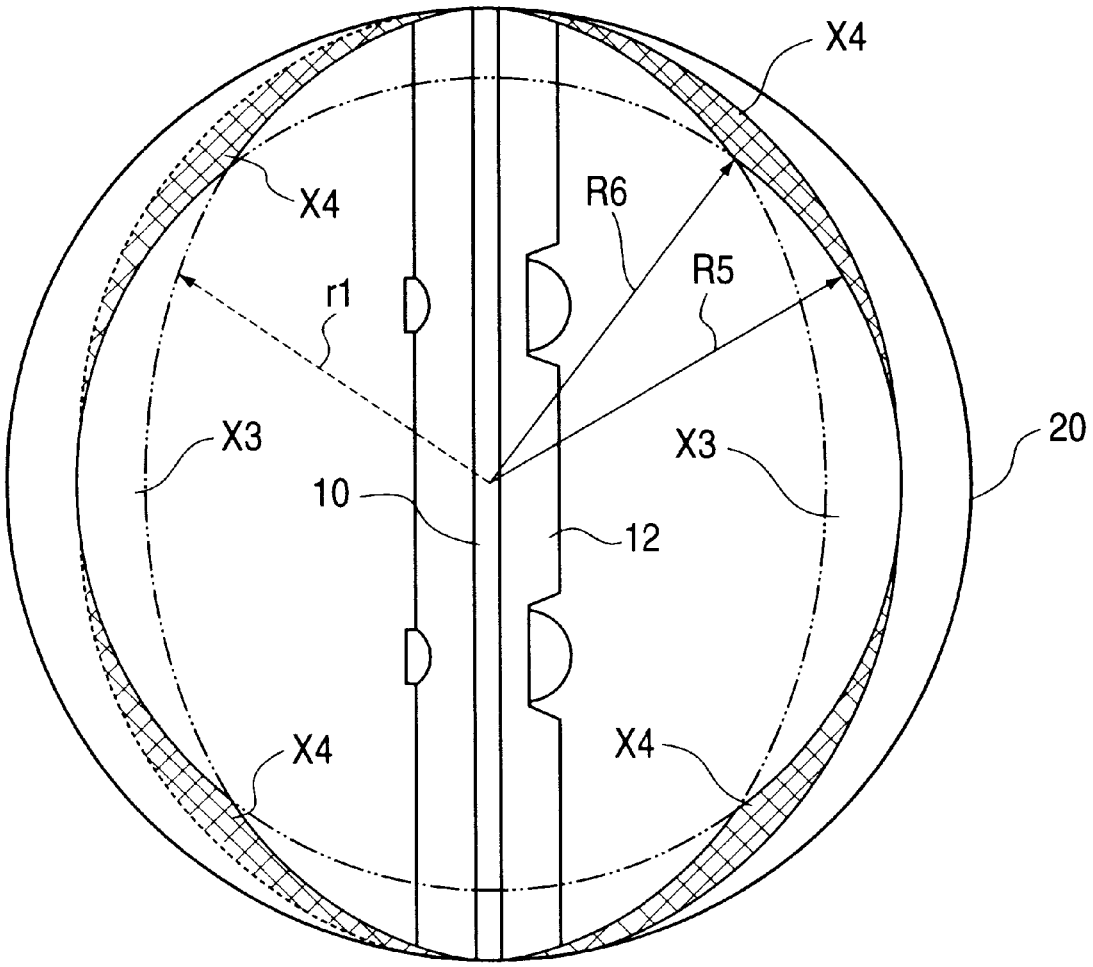
FIG. 3 is a view illustrating the inner surface side of the throttle body of the throttle valve control device for the internal combustion engine shown in FIG. 1 as seen from the downstream side of the throttle body of the throttle valve control device for the internal combustion engine shown in FIG. 1.

FIG. 3 is a view showing the inner surface side of the throttle body as seen from the downstream side (the O2 side of FIG. 2) of the throttle body of the throttle valve control device for the internal combustion engine, according to the above one embodiment of the present invention. In the drawing, the throttle valve 10 is in a state of being open at the fully-opened position (corresponding to the position coincident with the line connecting the points O1-O0-O2 to each other in FIG. 3).

As partly indicated by dashed lines, the inner surface of the throttle body 20 is shaoed into the spherical form of the radius r1 with the point shifted by the deviation e from the center O0 as the center. Further, a part of the spherical surface is brought into a form cut to the cylindrical form of the radius R5 from the center O0 as partly indicated by a two-dot chain line.

Thus, a region defined by the cylindrical surface of the inner surface X3 and regions in which the parts of the spherical surface remain as regions X4, are shaped in combined form. As the throttle valve 10 is turned, an aperture area, i.e., an air passage area defined between the throttle valve 10 and the inner surface X3 takes a gradually-increasing shape.

If the dimensions of the aforementioned respective portions are exemplified by taking a throttle body having a bore diameter 60ϕ as an example, then they are represented as follows: Incidentally, the meaning of the bore diameter =60ϕ indicates that the radius R3 is equal to 30 mm.

Radius R1=31 mm

Radius R2=31 mm

Radius R3=30 mm

Radius R4=30 mm

Radius R5=27 mm

Radius R6=24.3 mm

Radius r1=30.17 mm

Deviation e=1mm

Angle θ1=6°

Angle θ2=20°

Angle θ3=10°

Incidentally, the radius R6 corresponds a radius of a portion that remains as the apex of the region X4. In the state shown in FIG. 2, the angles θ1 to θ3 are set so as to be greater than the aforementioned angles respectively and the spherical surface portions and the composite surface portions are represented in form enlarged so as to be greater than actual.

The aforementioned respective dimensions are designed according to the characteristic of intake air quantity with respect to the degree of opening of the throttle valve required of a specific engine and also designed to the most suitable values according to the demands of the engine.

As the angle θ2 corresponding to the idle control region, the most suitable angle is selected in a range of 10° to 20° depending on the engine.

The shape of the inner surface X3 will next be explained with reference to FIG. 4.

Figure 4:
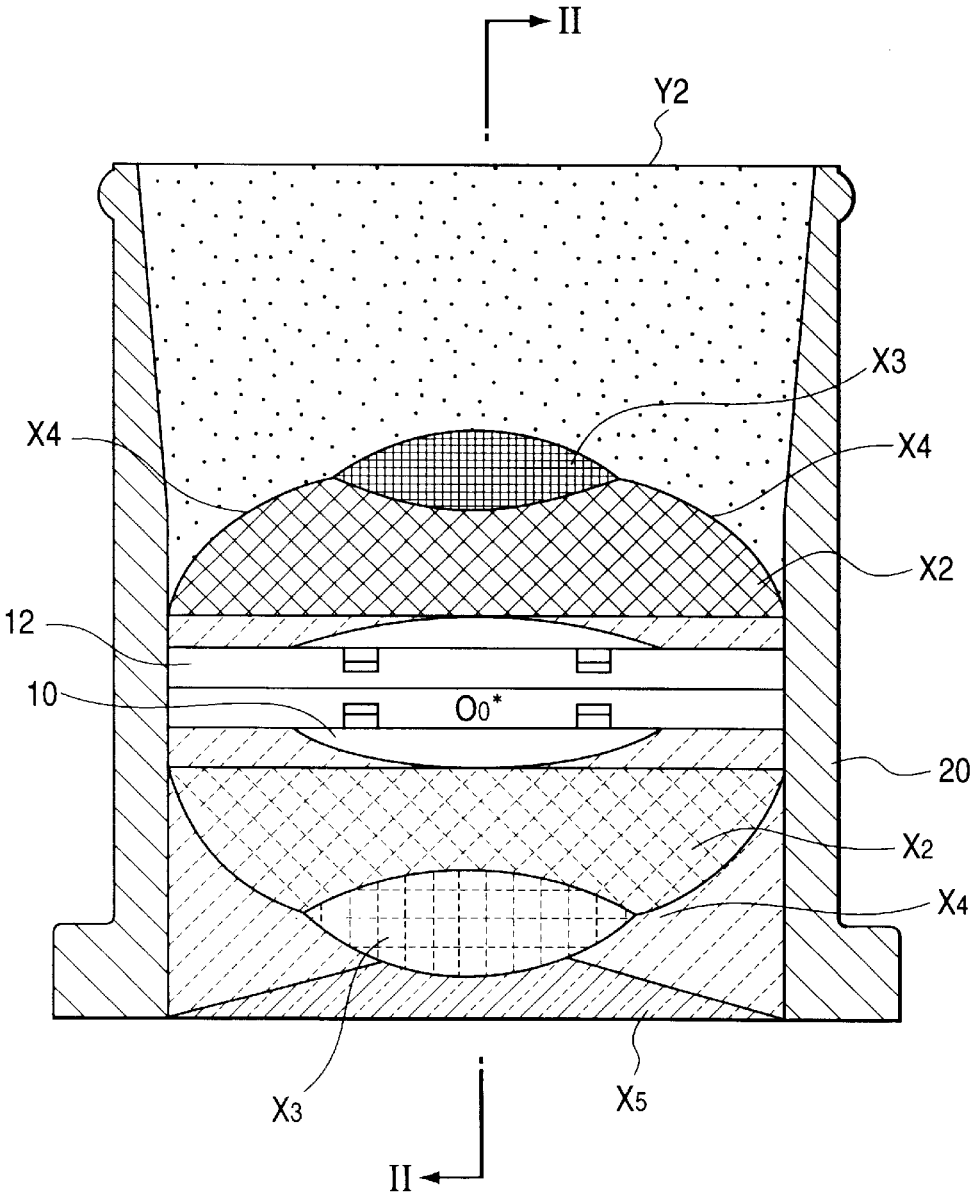
FIG. 4 is a cross-sectional view of the throttle body of the throttle valve control device for the internal combustion engine shown in FIG. 1 and is a cross-sectional view taken along line IV—IV of FIG. 2.

FIG. 4 is a view showing an inner wall surface of the throttle body of the throttle valve control device according to the above one embodiment as seen from the side thereof (in the direction indicated by arrow P in FIG. 2).

The throttle shaft 12 is rotatably attached to the throttle body 20. The throttle valve 10 is fixed to the throttle shaft 12. The neighborhood of the fully-closed angle of the throttle valve 10 is represented as the spherical inner surface X2. Further, a region following the spherical inner surface X2 has an inner surface X3 defined by the cylindrical surface. The shape of the inner surface X3 is brought into a surface having an elliptic shape surrounded by an upper circular arc and a lower circular arc. Since regions in which spherically-shaped inner surfaces X4 remain, exist on the right and left sides of each inner surface X3, composite regions each formed by the cylindrical surface and the spherical shape exist in the neighborhood of the inner surface X3.

The characteristic of the air flow rate with respect to the degree of opening of the throttle valve will next be explained using FIG. 5.

Figure 5:
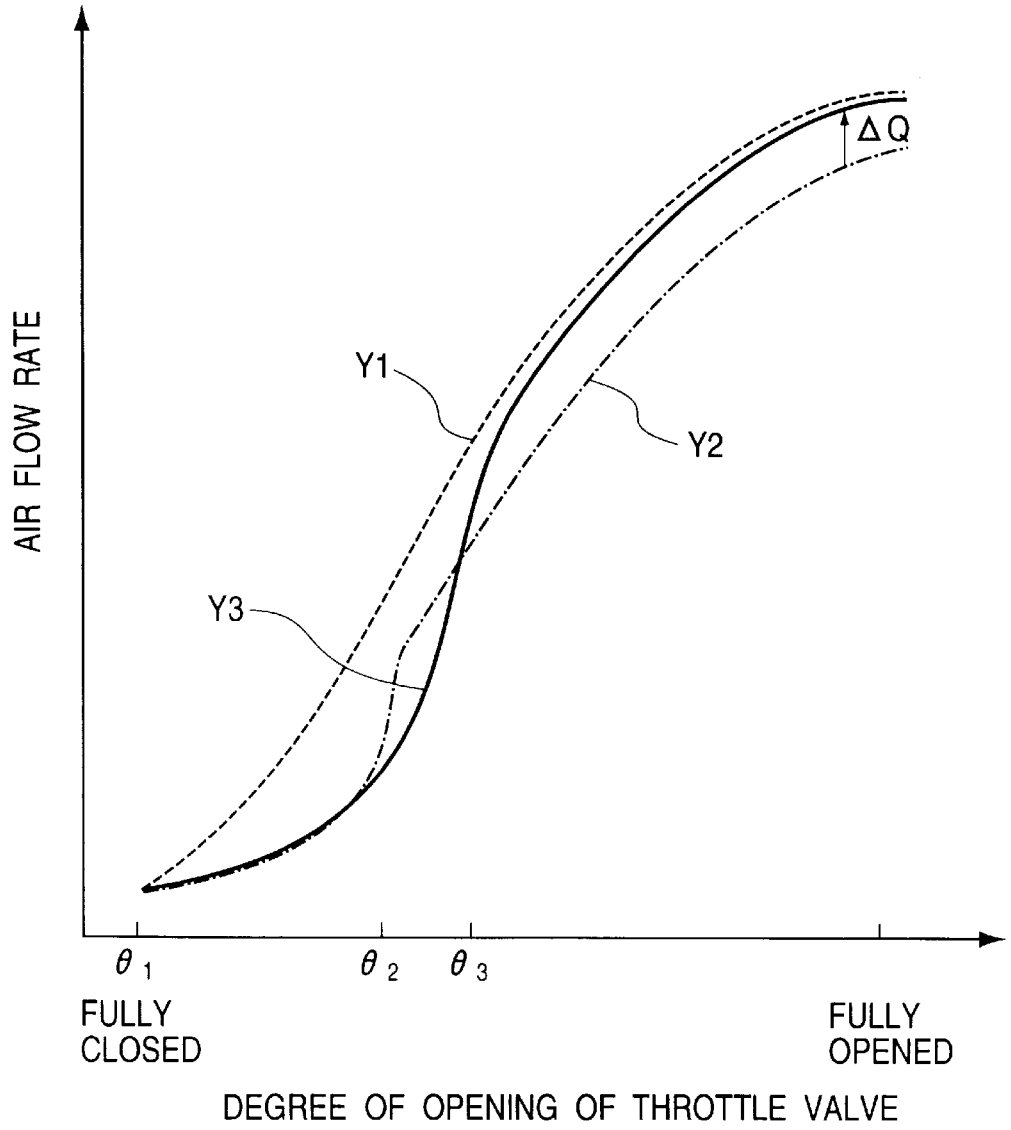
FIG. 5 is a view showing the relationship between the degree of opening of a throttle valve and an air flow rate.

FIG. 5 is a view showing the relationship between the degree of opening of the throttle valve and the air flow rate at the time that intake negative pressure is constant (−500 mmHg).

A characteristic indicated by a broken line Y1 is equivalent to a characteristic of an air flow rate with respect to the degree of opening of the throttle valve in the conventional straight bore type throttle body. With an increase in the degree of opening of the throttle valve, the air flow rate increases on a substantially proportional basis. However, a change (ΔQ/Δθ) between a change (Δθ) in the air flow rate and a change (Δθ) in the degree of opening of the throttle valve is large in the range of the angles θ1 to θ2, which is indicative of the idle control region, so that subtle control on the number of revolutions of the engine cannot be performed.

In contrast to the above characteristic, a characteristic indicated by a dashed line Y2 corresponds to a characteristic of an air flow rate with respect to the degree of opening of the throttle valve at the time that a partial (corresponding to the range of the angles θ1 to θ2) spherical bore of the conventional straight bore type throttle body is defined. In the range of the angles θ1 to θ2, which is indicative of the idle control region, the change (ΔQ/Δθ) between the change (ΔQ) in the air flow rate and the change (Δθ) in the degree of opening of the throttle valve can be made smaller than that produced by the broken line Y1 so that the subtle control on the number of revolutions of the engine can be performed. However, the air flow rate abruptly increases with the angle θ2 as the boundary and an offset or step is developed in the characteristic of the air flow rate with respect to the degree of opening of the throttle valve. As a result, a problem arises in that the controllability of the air flow rate is reduced. As is understood from the comparison with the broken line Y1, a reduction (−Δθ) in the air flow rate is produced in the neighborhood of the full opening of the throttle valve. This results from the influence of a pressure loss produced due to throttling at the spherical bore.

On the other hand, a characteristic indicated by a solid line Y3 is a characteristic of an air flow rate with respect to the degree of opening of the throttle valve at the time that the spherical bore and the bore having the composite surface formed by the spherical surface and the cylindrical surface both of which are employed in the above one embodiment of the present invention, are used. In the range of the angles θ1 to θ2, which indicates the idle control region, the change (ΔQ/Δθ) between the change (ΔQ) in the air flow rate and the change (Δθ) in the degree of opening of the throttle valve can be made small in a manner similar to the dashed line Y2 so that the subtle control on the number of revolutions of the engine can be performed. Further, since the air flow rate can be set so as to gradually increase in the range of the angles θ2 to θ3 as compared with the characteristic given by the dashed line Y2, no stepwise offset or step occurs in the characteristic of the air flow rate with respect to the degree of opening of the throttle valve. Thus, the controllability of the air flow rate can be improved. As a result, medium and low-velocity regions can be improved in drivability.

As is also understood from the comparison with the broken line Y1, no reduction (−ΔQ) is produced even in the air flow rate in the neighborhood of the full opening of the throttle valve. This is because the air flow rate in the vicinity of the full opening of the throttle valve would result in the pressure loss similar to the straight bore type by shaping the aperture area of the throttle valve into the gradually-varying form as in the composite surface formed by the spherical surface and the cylindrical surface. Thus, the output of the engine at the fully opening of the throttle valve is no longer reduced and hence a satisfactory full-throttle output can be obtained.

A throttle body of a throttle valve control device for an internal combustion engine, according to another embodiment of the present invention will next be explained with reference to FIG. 6.

Figure 6:
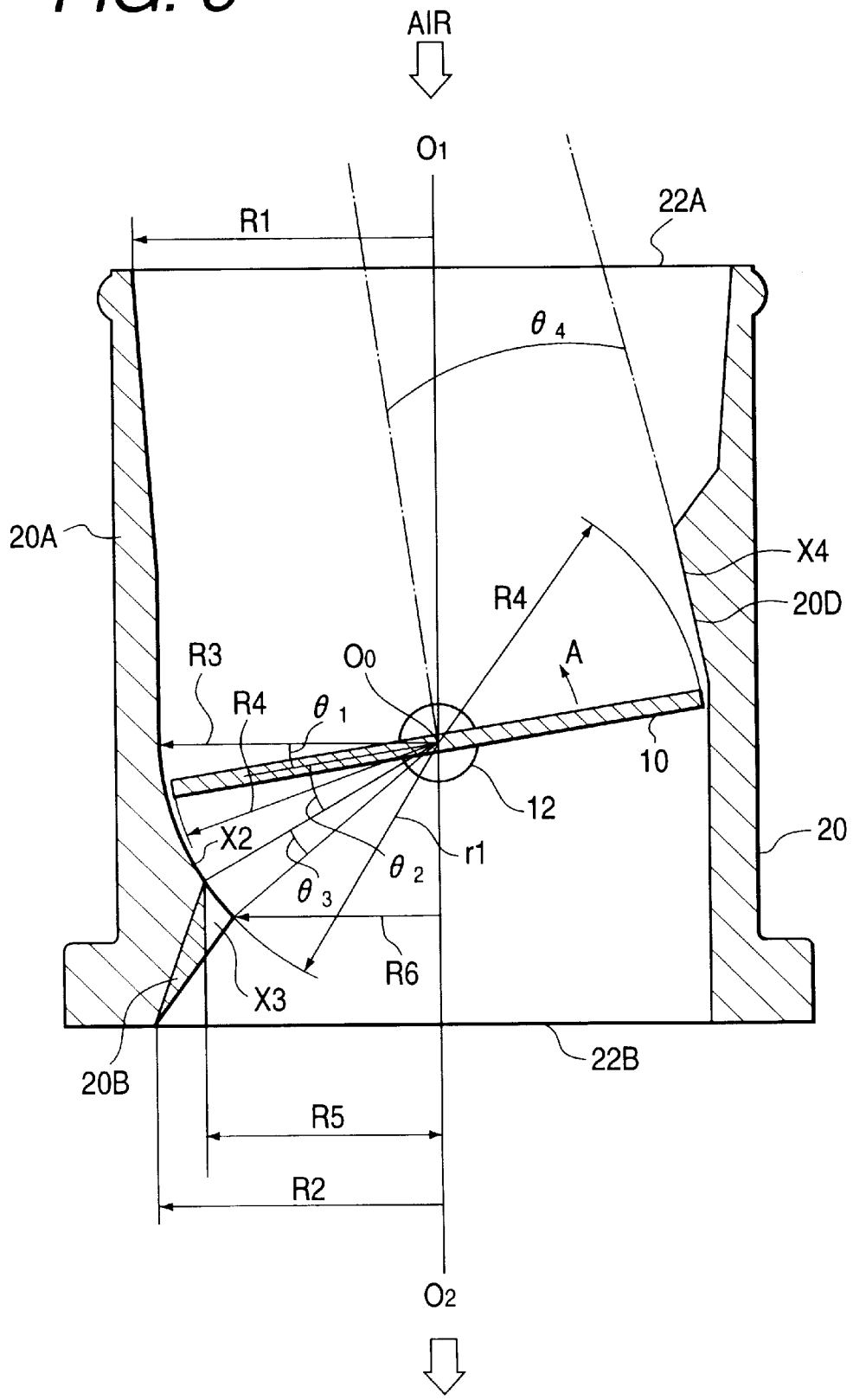
FIG. 6 is a cross-sectional view of a throttle body of a throttle valve control device for an internal combustion engine, according to another embodiment of the present invention.

FIG. 6 is a cross-sectional view of a throttle body of a throttle valve control device for an internal combustion engine, according to another embodiment of the present invention.

The present throttle body is different from that shown in FIG. 2 in that the downstream side of a throttle valve is defined as a spherical bore but the center thereof is not deviated and the upstream side of the throttle valve has a conically bored shape.

A throttle valve 10 is fixed to a throttle shaft 12. The throttle shaft 12 is rotatably supported by a throttle body 20. In the state illustrated in the drawing, the throttle valve 10 is in a fully-closed state. The throttle valve 10 is rotated about a point O0 in the direction indicated by arrow A. When the throttle valve 10 matches with a line connecting points O1-O0-O2 to each other, the throttle valve 10 is fully opened. The degree of opening of the throttle valve 10 is a type of 90 degrees or less.

Intake air is introduced from an opening 22A defined above the throttle body 20 and is discharged through an opening 22B defined below the throttle body 20. The upper opening 22A of the throttle body 20 is circular with the line connecting the points O0-O0-O2 to each other as the center and the radius thereof is given by R1. The lower opening 22B of the throttle body 20 is also circular with the line connecting the points O1-O0-O2 to each other as the center and the radius thereof is given by R2. Namely, the shape of a surface orthogonal to the line connecting the points O1-O0-O2 to each other is circular and the radius thereof is given by R3. Namely, the throttle body 20 is basically of a straight bore type wherein the shape of the upper opening 22A, the shape of the throttle valve 10 and the shape of the lower opening 22B are respectively circular and the centers of their circular shapes are placed on the straight line connecting the points O1-O0-O2 to each other.

In the cross-sectional state illustrated in the drawing, the throttle body 20 comprises a base portion 20A used as a principal structural body, a composite surface portion 20B' formed by a spherical surface and a cylindrical surface provided on the downstream side of the base portion 20A, and a conical surface 20D provided on the upstream side of the base portion 20A. Now, the base portion 20A, the composite surface portion 20B' and the conical surface portion 20D are integrally formed by a die cast process but are shown as distinguished from each other for description of the embodiment.

The shape of an inner surface of the throttle body 20 will next be explained. The illustrated state indicates that the throttle valve 10 is in the fully-closed state. However, the throttle valve 10 is inclined only an angle θ1 equal to a fully-closed angle toward a line orthogonal to the line joining the points O1-O0-O2 to each other as seen from the center O0 of the throttle valve 10. An inner surface X1 of the throttle body 20 is shaped in the form of a cylinder having a radius of R3 within the range of the fully-closed angle θ1.

Next, the throttle valve 10 is turned in the direction indicated by arrow A and an inner surface X2 provided on the downstream side of the throttle valve 10 is shaped in the form of a spherical surface in the range of a angle θ2. The center of the spherical surface corresponds to the center O0 of rotation of the throttle valve 10 and is shaped into a spherical surface form of a radius r1. At this time, the radius of the throttle valve 10 is given by R4 and the interval defined between the locus of the radius R4 and the locus of the spherical surface having the radius r1 remains unchanged even if the throttle valve 10 turns. Thus, an open or aperture area, i.e., an air passage area formed between the throttle valve 10 and the inner surface X2 as the throttle valve 10 turns, remains unchanged in this range.

On the other hand, the throttle valve 10 is rotated in the direction indicated by arrow A and hence an inner surface X4 located on the upstream side of the throttle valve 10 is shaped into a conical surface in the range of the angle θ2. The term cone here indicates a conical shape whose bottom face is formed by the throttle valve 10 and whose apex is placed on a line orthogonal to the surface of the throttle valve 10 as seen from the center O0 when the throttle valve 10 is in the illustrated fully-closed state. The angle formed as seen from the apex. thereof corresponds to θ4. The throttle valve 10 plots an arcuate locus with the radius of R4 with the center O0 as the center of rotation thereof. Further, an aperture area formed between the peripheral edge of the throttle valve 10 and the inner surface X4 is brought into a gradually-varying shape. When the angle θ4 is rendered large, the rate of change in the aperture area increases, whereas when the angle θ4 is reduced, the rate of change in the aperture area decreases. The arbitrary selection of the angle θ4 allows the setting of a characteristic of a change in the air flow rate with respect to the degree of opening of the throttle valve to an arbitrary characteristic.

The region of the angle θ2 serves as an idle control region, which is equivalent to a region for controlling the number of revolutions at idle and various loads such as an air conditioner load, a power steering load, an automatic transmission load, etc. by an electronic control throttle. Since a number-of-revolutions control accuracy corresponding to a high accuracy of about ±20 rpm is required in such an idle control region, the throttle body is shaped in the form of a conical bore so as to reduce the change in the aperture area with respect to the change in the degree of opening of the throttle valve 10.

Next, an inner surface X3 subsequent to the inner surface X2 having the spherical shape is represented in a composite form of a spherical surface and a cylindrical surface. Namely, the inner surface X3 is shaped in the form of a spherical surface by further extending the spherical surface of the radius r1 by an angle θ3, after which it is brought into a shape cut to a cylindrical shape of a radius R5 with respect to the line connecting the points O1-O0-O2 to each other. Therefore, the inner surface X3 results in the composite shape of the spherical surface and the cylindrical surface. Thus, an aperture area, i.e., an air passage area formed between the throttle valve 10 and the inner surface X3 takes a gradually-increasing shape as the throttle valve 10 is turned. At this time, a change in the aperture area with respect to a change in the degree of opening of the throttle valve 10 is designed so as to be greater than the change in the aperture area with respect to the charge in the degree of opening of the throttle valve 10 in the region of the conical surface X4.

Since the composite surface portion 20B' is not provided in the prior art, the change in the aperture area with respect to the change in the degree of opening of the throttle valve 10 abruptly increases when the throttle valve 10 is turned over the angle θ2, so that a abrupt change in the air flow rate with respect to the degree of opening of the throttle valve 10, a so-called stepwise flow-rate change is produced. In the present embodiment, however, such an abrupt change in the air flow rate is no longer produced. Thus, the controllability on the air flow rate can be also improved. As a result, the medium- and low-speed regions are improved in drivability.

Incidentally, the throttle body 20 is manufactured by the die cast process as described above. The composite surface portion 20B' can be formed by processing the range of the angle θ2+θ3 into the spherical shape and cutting it to the cylindrical shape of the radius R5 upon manufacturing a diecasting die.

This is because the air flow rate in the vicinity of the full opening of the throttle valve would result in the pressure loss similar to the straight bore type by shaping the aperture area of the throttle valve into the gradually-varying form as in the composite surface formed by the spherical surface and the cylindrical surface. Thus, the output of the engine at the fully opening of the throttle valve is no longer reduced and hence a satisfactory full-throttle output can be obtained.

A throttle body of a throttle valve control device for an internal combustion engine, according to a further embodiment of the present invention will next be explained with reference to FIG. 7.

Figure 7:
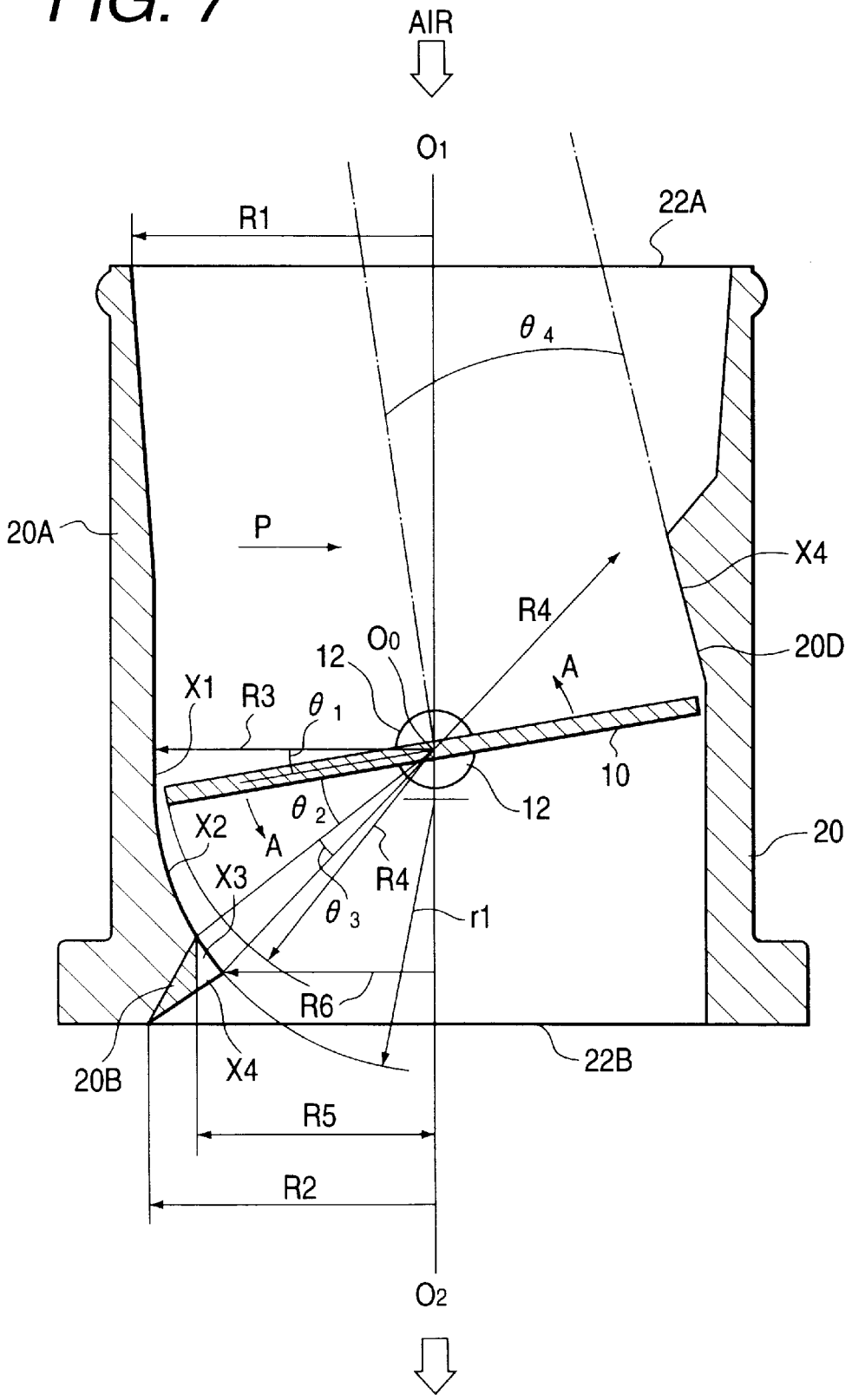
FIG. 7 is a cross-sectional view of a throttle body of a throttle valve control device for an internal combustion engine, according to a further embodiment of the present invention.

FIG. 7 is a cross-sectional view of a throttle body of a throttle valve control device for an internal combustion engine, according to a further embodiment of the present invention.

The present throttle body is different from that shown in FIG. 2 in that the upstream side of a throttle valve has a conically bored shape. Incidentally, the downstream side of the throttle valve is defined as a spherical bore and the center thereof takes a deviated shape.

A throttle valve 10 is fixed to a throttle shaft 12. The throttle shaft 12 is rotatably supported by a throttle body 20. In the state illustrated in the drawing, the throttle valve 1 is in a fully-closed state. The throttle valve 10 is rotated about a point O0 in the direction indicated by arrow A. When the throttle valve 10 matches with a line connecting points O1-O0-O2 to each other, the throttle valve 10 is fully opened. The degree of opening of the throttle valve 10 is a type of 90 degrees or less.

Intake air is introduced from an opening 22A defined above the throttle body 20 and is discharged through an opening 22B defined below the throttle body 20. The upper opening 22A of the throttle body 20 is circular with the line connecting the points O1-O0-O2 to each other as the center and the radius thereof is given by R1. The lower opening 22B of the throttle body 20 is also circular with the line connecting the points O1-O0-O2 to each other as the center and the radius thereof is given by R2. Namely, the shape of a surface orthogonal to the line connecting the points O1-O0-O2 to each other is circular as seen from the center O0 of the throttle valve 10 and the radius thereof is given by R3. Namely, the throttle body 20 is basically of a straight bore type wherein the shape of the upper opening 22A, the shape of the throttle valve 10 and the shape of the lower opening 22B are respectively circular and the centers of their circular shapes are placed on the straight line connecting the points O1-O0-O2 to each other.

In the cross-sectional state illustrated in the drawing, the throttle body 20 comprises a base portion 20A used as a principal structural body, a composite surface portion 20B' formed by a spherical surface and a cylindrical surface provided on the downstream side of the base portion 20A, and a conical surface portion 20D provided on the upstream side of the base portion 20A. Now, the base portion 20A, the composite surface portion 20B' and the conical surface portion 20D are integrally formed by a die cast process but are shown as distinguished from each other for description of the embodiment.

The shape of an inner surface of the throttle body 20 will next be explained. The illustrated state indicates that the throttle valve 10 is in the fully-closed state. However, the throttle valve 10 is inclined only an angle θ1 equal to a fully-closed angle toward a line orthogonal to the line joining the points O1-O0-O2 to each other as seen from the center O0 of the throttle valve 10. An inner surface X1 of the throttle body 20 is shaped in the form of na a cylinder having a radius of R3 within the range of the fully-closed angle θ1.

Next, the throttle valve 10 is turned in the direction indicated by arrow A and hence an inner surface X2 lying within the range of the angle θ2 is shaped in the form of a spherical surface. The center of the spherical surface is shaped into a spherical surface of a radius r1 with positions shifted by displacements or deviations e from the center O0 of rotation of the throttle valve 10 to the downstream and upstream sides thereof respectively as the centers. At this time, the radius of the throttle valve 10 is given by R4 and an open or aperture area, i.e., an air passage area formed between the throttle valve 10 and the inner surface X2 takes a graduLally-increasing shape as the throttle valve 10 rotates, as is apparent from the difference between the locus of the raLdius R4 and the locus of the spherical surface of the radius r1. Since the deviation e is equivalent to the slight amount of displacement, a change in the aperture area with respect to a change in the degree of opening of the throttle valve 10 is designed so as to decrease. The region of the angle θ2 serves as an idle control region, which is equivalent to a region for controlling the number of revolutions at idle and various loads such as an air conditioner load, a power steering load, an automatic transmission load, etc. by an electronic control throttle. Since a number-of-revolutions control accuracy corresponding to a high accuracy of about ±20 rpm is required in such an idle control region, the throttle body is shaped in the form of a spherical bore so as to reduce the change in the open area with respect to the change in the degree of opening of the throttle valve 10.

On the other hand, the throttle valve 10 is rotated in the direction indicated by arrow A and hence an inner surface X4 located on the upstream side of the throttle valve 10 is shaped into a conical surface in the range of the angle θ2. The term cone here indicates a conical shape whose bottom face is formed by the throttle valve 10 and whose apex is placed on a line orthogonal to the surface of the throttle valve 10 as seen from the center O0 when the throttle valve 10 is in the illustrated fully-closed state. The angle formed as seen from the apex thereof corresponds to θ4. The throttle valve 10 plots ar arcuate locus with the radius of R4 with the center O0 as the center of rotation thereof. Further, an aperture area formed between the peripheral edge of the throttle valve 10 and the inner surface X4 is brought into a gradually-varying shape. When the angle θ4 is rendered large, the rate of change in the aperture area increases, whereas when the angle θ4 is reduced, the rate of change in the aperture area decreases. The arbitrary selection of the angle θ4 allows the setting of a characteristic of a change in the air flow rate with respect to the degree of opening of the throttle valve to an arbitrary characteristic.

The region of the angle θ2 serves as an idle control region, which is equivalent to a region for controlling the number of revolutions at idle and various loads such as an air conditioner load, a power steering load, an automatic transmission load, etc. by an electronic control throttle. Since a number-of-revolutions control accuracy corresponding to a high accuracy of about ±20 rpm is required in such an idle control region, the throttle body is shaped in the form of a conically-defined bore so as to reduce the change in the aperture area with respect to the change in the degree of opening of the throttle valve 10.

Next, an inner surface X3 subsequent to the inner surface X2 having the spherical shape is represented in a composite form of a spherical surface and a cylindrical surface. Namely, the inner surface X3 is shaped in the form of a spherical surface by further extending the spherical surface of the radius r1 by an angle θ3, after which it is brought into a shape cut to a cylindrical shape of a radius R5 with respect to the line connecting the points O1-O0-O2 to each other. Therefore, the inner surface X3 results in the composite shape of the spherical surface and the cylindrical surface. Thus, an aperture area, i.e., an air passage area formed between the throttle valve 10 and the inner surface X3 takes a gradually-increasing shape as the throttle valve 10 is turned. At this time, a change in the aperture area with respect to a change in the degree of opening of the throttle valve 10 is designed so as to be greater than the change in the aperture area with respect to the change in the degree of opening of the throttle valve 10 in the region of the conical surface X4.

Since the composite surface portion 20B' is not provided in the prior art, the change in the aperture area with respect to the change in the degree of opening of the throttle valve 10 abruptly increases when the throttle valve 10 is turned over the angle θ2, so that a abrupt change in the air flow rate with respect to the degree of opening of the throttle valve 10, a so-called stepwise flow-rate change is produced. In the present embodiment, however, such an abrupt change in the air flow rate is no longer produced. Thus, the controllability on the air flow rate can be also improved. As a result, the medium- and low-speed regions are improved in drivrability.

Incidentally, the throttle body 20 is manufactured by the die cast process as described above. The composite surface portion 20B' can be formed by processing the range of the angle θ2+θ3 into the spherical shape and cutting it to the cylindrical shape of the radius R5 upon manufacturing a diecasting die.

This is because the air flow rate in the vicinity of the full opening of the throttle valve would result in the pressure loss similar to the straight bore type by shaping the aperture area of the throttle valve into the gradually-varying form as in the composite surface formed by the spherical surface and the cylindrical surface. Thus, the output of the engine at the fully opening of the throttle valve is no longer reduced and hence a satisfactory full-throttle output can be obtained.

The spherical surface on the downstream side of the throttle valve provides or brings about a characteristic in which since the spherical surface is equivalent to one formed by deviating the center of the spherical surface from the center of rotation of the shaft of the throttle valve by a predetermined amount, the air flow rate gradually increases as the throttle valve turns and since the upstream side of the throttle valve is shaped in the form of the conical surface, the air flow rate gradually increases as the throttle valve rotates. If the shape of the throttle bore is now supposed to be a spherical surface whose central position is displaced, then the rate of change in air flow quantity or rate Q with respect to the degree θ of opening of the throttle valve tends to decrease as the degree θ of opening of the throttle valve increases. Namely, the change rate falls within $\Delta Q/\Delta\theta<1$. Since, on the other hand, the rate of change in air flow quantity Q with respect to the degree θ of opening of the throttle valve tends to increases, a characteristic indicative of a change in the air flow rate with respect to the degree of opening of the throttle valve, which is different from that obtained in the aforementioned embodiment, can be obtained by utilizing both in combination.

According to such an embodiment, an air quantity control device for controlling a bypass air passage having a passage sectional area of ϕ14 by an ISC valve is removed from service and air flow rate control equivalent thereto could be performed by a throttle valve attached to an air intake pipe of ϕ60. The resolution for detecting the degree of opening of the throttle valve at this time is represented as a 0.1 deg level. This becomes sufficiently feasible as for the control device under the present-existing detected level.

Thus, the idling engine speed could be controlled with an accuracy of ±20 rpm by using the throttle valve. Namely, the throttle valve control device according to the present embodiment can rev up and lower the engine by 20 rpm when the degree of opening of the throttle valve is changed by 0.1 deg with the motor.

More specific embodiments will next be illustrated to describe the effects of the present invention. Further improved embodiments will be further explained.

Figure 8:
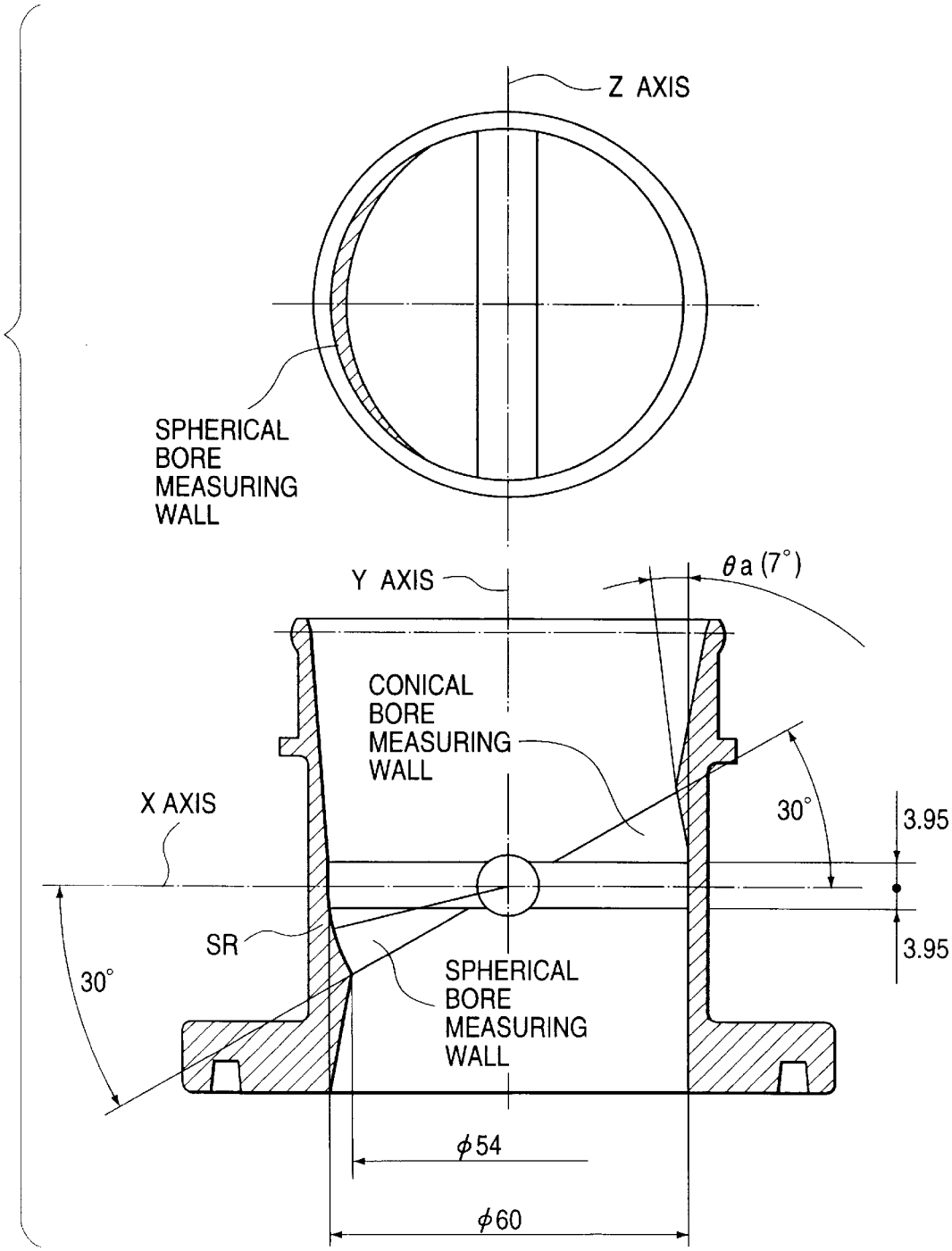
FIG. 8 is a cross-sectional view showing the structure of a throttle body forming the basis of a throttle valve control device for an internal combustion engine, according to the present invention.

Referring to FIG. 8, a cylindrical bore having a cylindrical profile extending over the range of 3.95 mm is defined on the upstream and downstream sides from the center of rotation of a throttle valve shaft lying within a throttle bore inner wall. Following the cylindrical profile, a spherical profile is provided on the downstream side as a spherical metering wall so as to extend to a position (where a base point is defined as an X-axis line passing through the center of the throttle valve shaft and being orthogonal to the central axis (Y axis) of the bore) of a degree-of-opening 30°. A fanwise conical profile is provided on the side downstream further from the position. The minimum value of a bore diameter on the downstream side is equal to ϕ54 at a point to perform switching between the spherical bore and the conical bore. The widest dimension of an outlet on the downstream side is ϕ60.

Incidentally, the center of a circular arc of the spherical profile is defined as a point of intersection of the center of the axis of rotation of the throttle valve and the central axis (Y axis) of the bore in the present embodiment.

On the upstream side, a conical profile (inclined 7° toward the Y-axis side with respect to the cylindrical profile) is provided as a tapered conical bore measuring wall following the cylindrical profile so as to extend up to the degree of opening of the throttle valve 30° (a base point is defined in a manner similar to the downstream-side spherical profile). Thus, the upstream side is shaped into a conical profile extending to an opening.

In the present embodiment, the air flow quantity could be changed by 3.4 liters/min. when the throttle valve was opened and closed by 0.1 deg in a region in which the total air flow quantity Qa was less than or equal to 250 liters per min. When the total air flow quantity ranges from 250 liters/min. to 700 liters/min., the air flow quantity could be changed by 7.2 liters/min. when the throttle valve was opened and closed by 0.1 deg. The pressure loss at the full opening of the throttle valve could be limited to 1.1 times the straight bore of ϕ60.

In the present embodiment, a required resolution of 7 liters/min. or less prior to the warming up of the engine and a required resolution of 3.6 liters/min. posterior to the warming up of the engine can be substantially achieved. Further, the pressure loss at the full opening of the throttle valve can be restricted to 1.1 times. The present embodiment can be put to practical use.

In the present structure, however, the clearance defined between the leading end of the throttle valve and the bore wall surface is always kept its 0.1 mm or less over the range of 30° in the region of the spherical profile. Further, the throttle valve is apt to cause dragging and non-combustion products are liable to adhere. Moreover, a problem is considered to arise in that the rate of change in air flow rate at the time that the degree of opening of the throttle valve changes from the spherical profile region to the conical profile region, is large and the stepwise phenomenon occurs in the air flow rate control characteristic to thereby make the number of revolutions of the engine unstable.

The former problem has been described previously. As described in the embodiment, the problem can be solved by slightly displacing the central position of the spherical profile toward the upstream and downstream sides on the bore central axis (Y axis). As the throttle valve whose center is displaced in this way, opens, the clearance defined between the bore wall surface and the spherical profile gradually increases, so that the dragging and the adhesion of foreign substances are hard to occur.

When the resolution of Qa presents the problem from the gradual increase in the clearance defined between the measuring wall and the leading end of the throttle valve, the problem can be solved by defining both the upstream and downstream wall surfaces as the measuring walls of the spherical profile. This is because the degree of enlargement of the clearance for the spherical profile is smaller than that for the conical profile.

Figure 9:
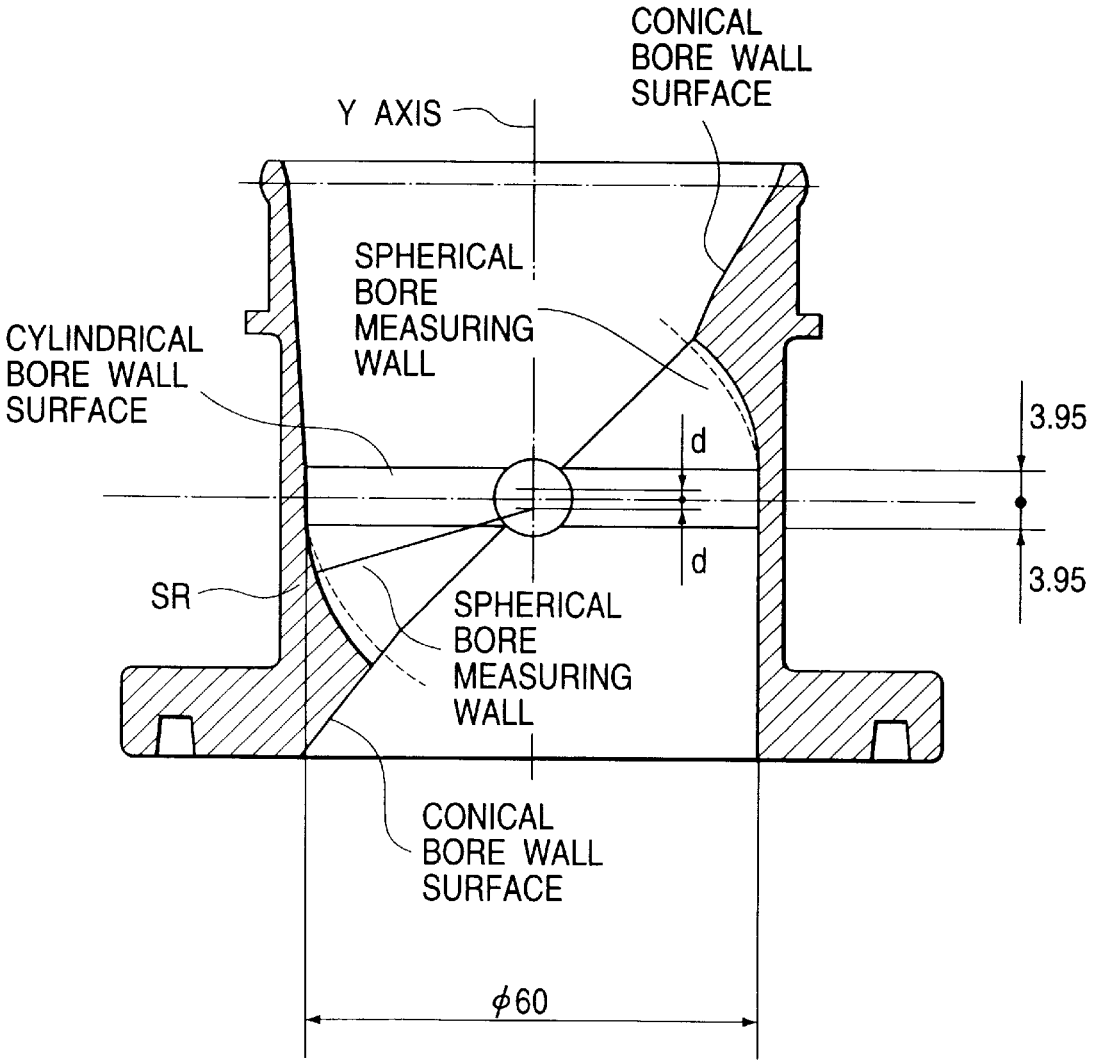
FIG. 9 is a cross-sectional view illustrating a specific embodiment of the present invention.

This structure will be shown in FIG. 9. In the embodiment illustrated in FIG. 9, measuring walls are formed by a pair of spherical profile portions obtained by respectively displacing the central positions of spherical profiles toward the upstream and downstream sides by d=1 mm along a Y axis. Portions indicated by broken lines respectively indicate the loci of the leading ends of the throttle valve. The clearance or gap defined between each locus and the spherical profile gradually increases as the degree of opening of the throttle valve opens.

The embodiment in which the central point of the spherical profile is displaced along the Y axis, can solve the former problem but cannot resolve the latter problem to a sufficient degree. Namely, the latter problem is that the present embodiment brings about a discontinuous and large change in air flow rate during the process of going from a spherical bore measuring wall region to a conical bore wall region following the spherical bore measuring wall region.

One solution to this problem has been described above. This is one in which the wall-surface profile following the spherical profile is not abruptly shaped into the fan-shaped conical profile and the rate of change in its passage sectional area is made smooth with the cylindrical profile interposed therebetween.

Figure 10:
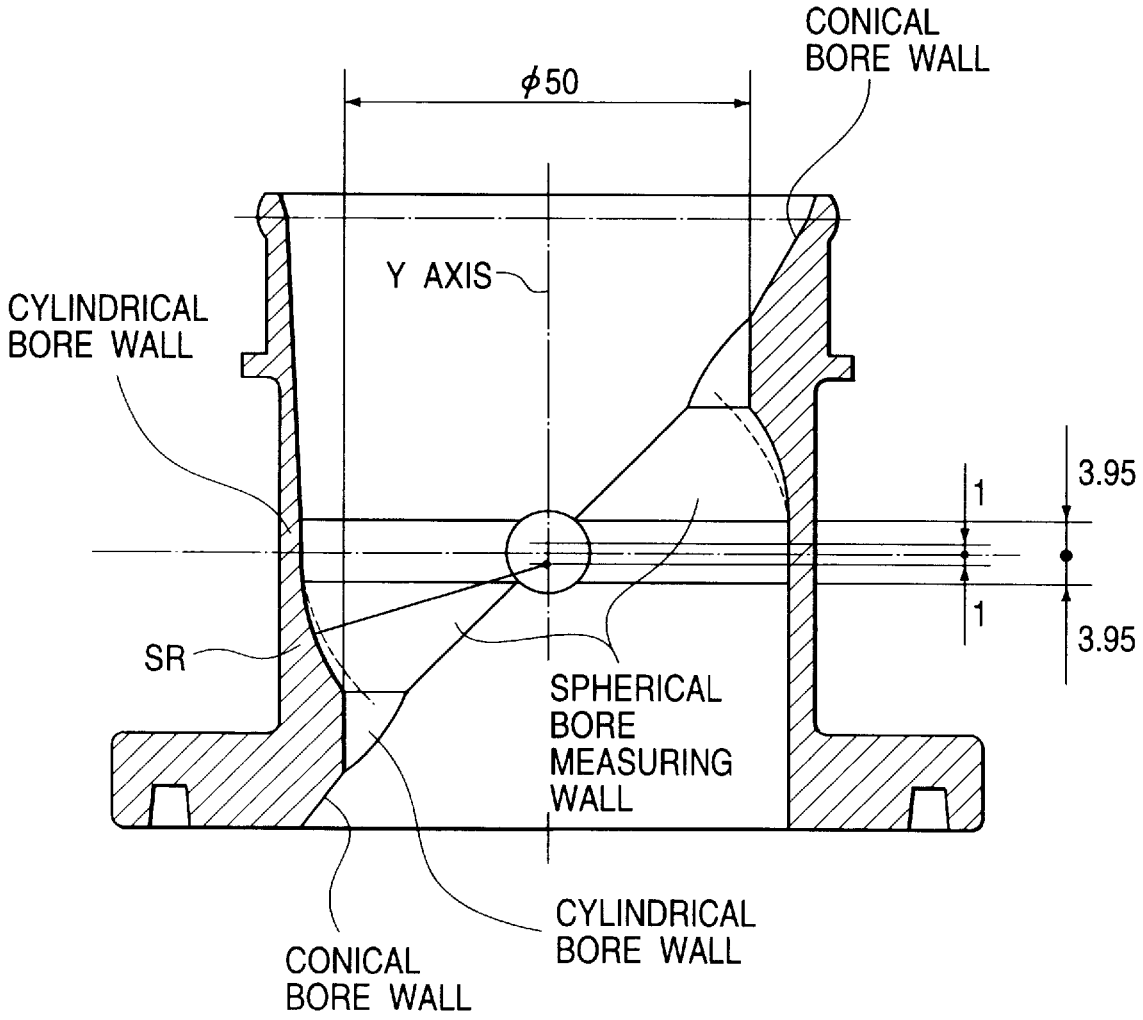
FIG. 10 is a cross-sectional view depicting a specific structure of another embodiment of the present invention.

FIG. 10 shows its specific embodiment. In the present embodiment, cylindrical bore walls each comprised of a cylindrical profile of 3.95 mm were first provided so as to extend in upward and downward directions from the center of the axis of rotation of a throttle valve. Following the their wall surfaces, spherical bore measuring walls comprised of spherical profiles formed by a pair of circular arcs whose radii R=30 mm arid whose centers are located at positions on a Y axis, spaced by 1 mm from the center of the rotation axis of the throttle valve as seen in the upward and downward directions were provided. Their spherical profiles are terminated at positions where the distances extending from the Y axis respectively reach 25 mm ($\phi$=50). Following them, cylindrical bore walls (set to 8 mm so as to extend along the Y axis in parallel as seen on the upstream and downstream sides) formed of cylindrical profiles of $\phi$=50 were provided. Further, portions extending from their terminations to upper and lower openings were formed as conical bore walls made up of conical profiles respectively.

Figure 11:
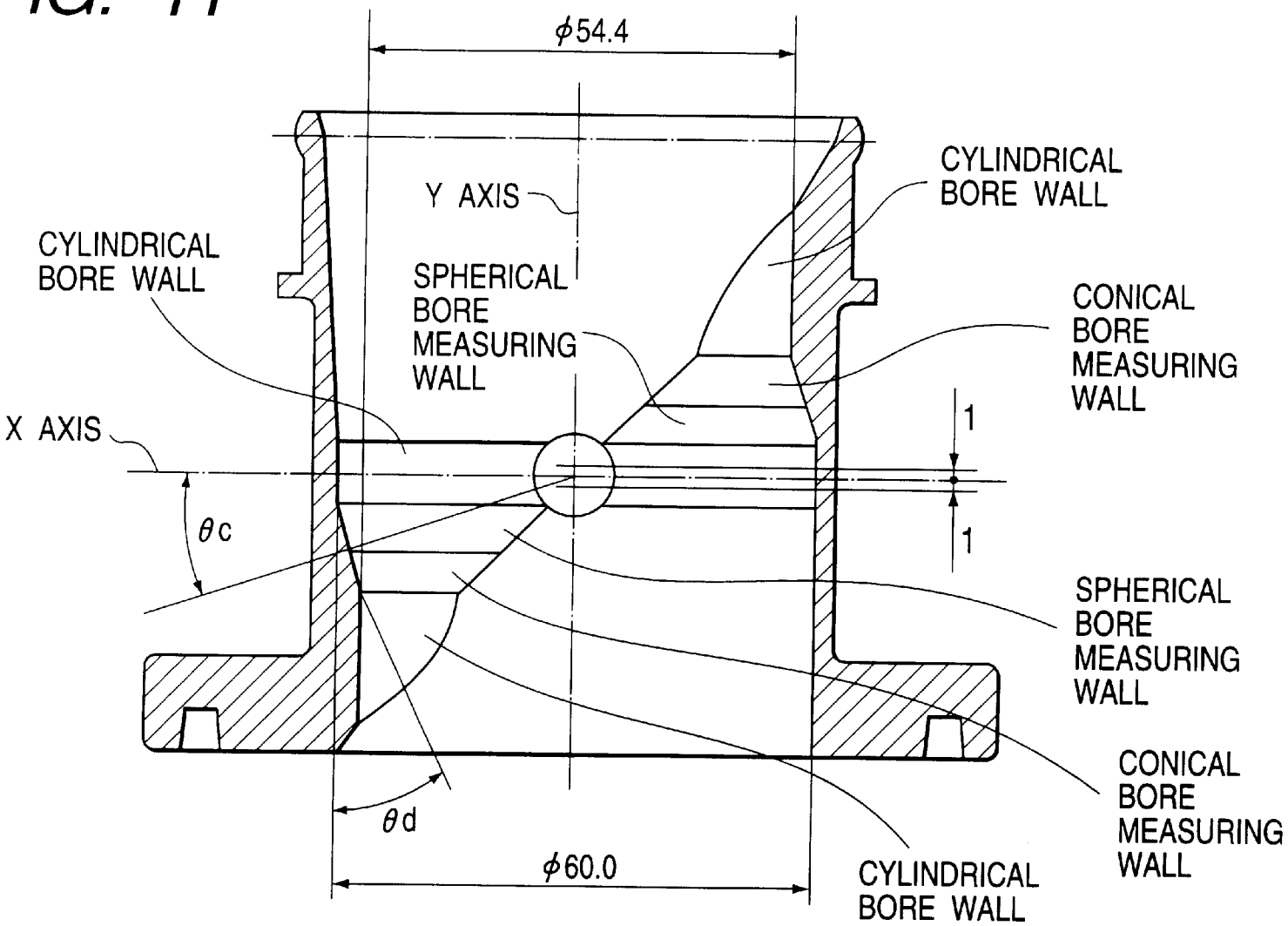
FIG. 11 is a cross-sectional view showing a specific structure of a further embodiment of the present invention.
Figure 12:
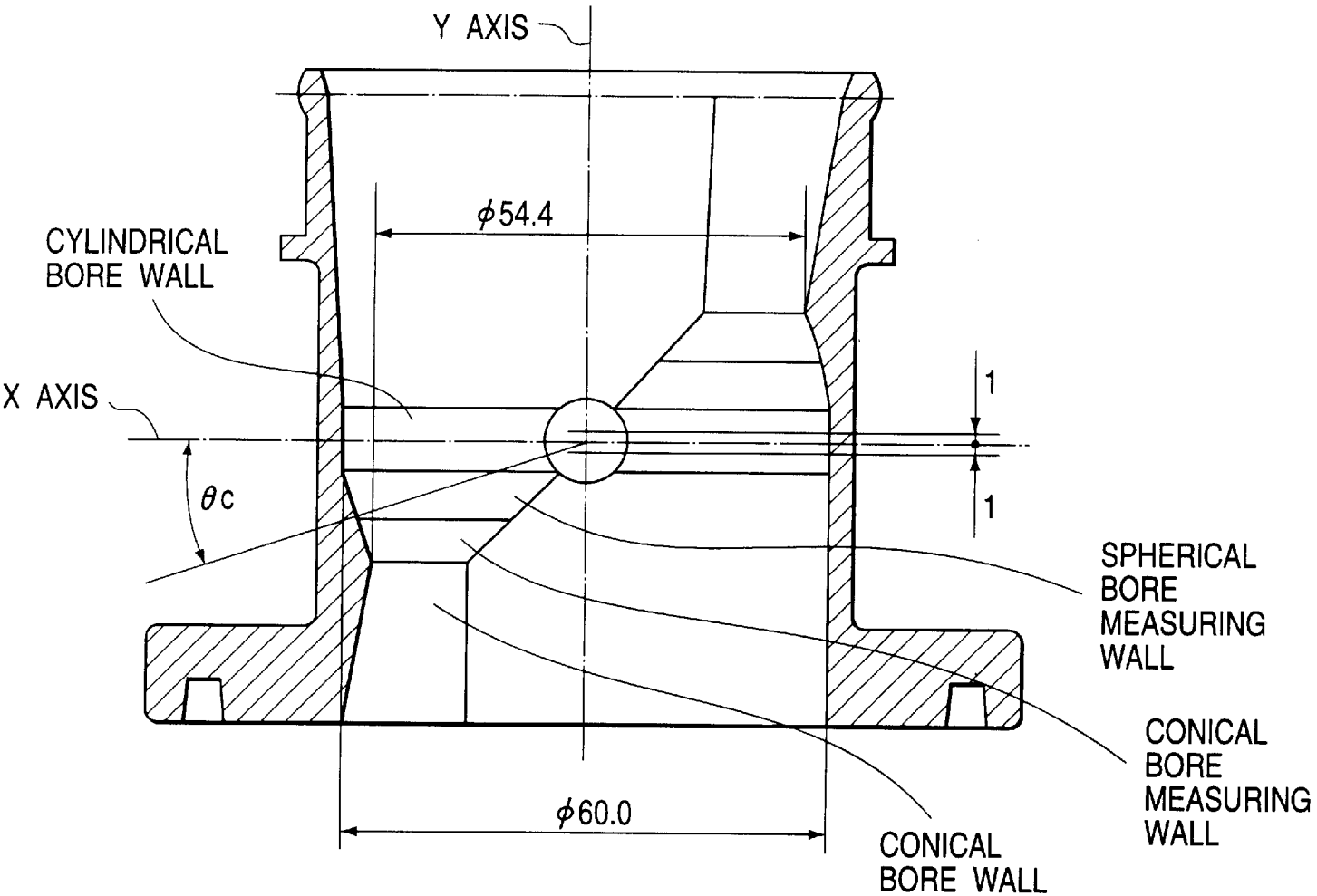
FIG. 12 is a cross-sectional view illustrating a specific structure of a still further embodiment of the present invention.

Further, FIGS. 11 and 12 show other embodiments respectively.

In the embodiment illustrated in FIG. 11, curved surfaces following spherical profile portions were formed by conical bore measuring walls made up of conical surface profiles extending in tangential directions of spherical profiles respectively. Further, cylindrical bore walls made up of cylindrical surface profiles were respectively provided on the upstream and downstream sides of the conical bore measuring walls. Finally, conical bore walls were constructed so as to extend to an outlet and an inlet respectively.

In the embodiment illustrated in FIG. 12, conical bore measuring walls were provided following spherical bore measuring walls and conical bore walls were formed on the upstream and downstream sides so as to extend to an outlet and an inlet, respectively.

In both FIGS. 11 and 12, the amounts of eccentricity of the centers of the spherical bore measuring walls were set to 1 mm on the Y axis as seen in the upward and downward directions. A point of switching between the spherical bore measuring wall and the conical bore measuring wall was set as an angular position of $\theta c=16°$ with a line passing through the central point of the spherical bore measuring wall and parallel to an X axis as a base point. Since the degrees of full closing and opening of the throttle valve are set to 6° respectively, a range from the fully-closed position to 11° is measured by the corresponding spherical bore measuring wall. A range from the measured point to a point where a bore diameter reaches 54.4 mm, was defined as the conical bore measuring wall.

Incidentally, air flow rate characteristics can be selected depending on how to determine the minimum diameters of the bores and by adjusting inclinations $\theta d$ of the conical bore measuring walls in FIGS. 11 and 12 respectively.

When the conical bore measuring walls following the spherical bore measuring walls are slopingly formed along the tangential lines of the conical bore measuring walls respectively, their linked portions result in smoothed surfaces and thereby stripes and stepwise offsets are not produced in bore inner wall surfaces. Therefore, the flow of air does not fall in disorder and the measuring accuracy is not degraded.

The advantageous effects of the respective embodiments will be explained below specifically while being interspersed with calculations and actually-measured values.

Upon idle control under which an intake air quantity Qa is less, intake negative pressure on the downstream side of the throttle valve is greater than or equal to −350 mmHg. At this time, the flow of air results in a critical flow within an intake passage defined by the throttle valve and a bore measuring wall surface. A critical flow rate of air flowing through a nozzle and an orifice can be estimated in accordance with an equation 1 obtained by expanding a one-dimensional Bernoulli's equation supposing that wall friction is neglected and the flow of air is an isoentropic flow.

It is however necessary to experimentally determine a flow coefficient C. Qa employed in each embodiment is estimated using the same equation:

$$Qa(m^3/s)=C\cdot A\cdot(2/k+1)^{1/k-1}\{2Po\cdot k/\rho o(k+1)\}^{0.5} \quad \text{equation 1}$$

where C: flow coefficient, A: effective area of measuring intake passage ($m^2$), k: ratio of specific heat, Po: valve upstream pressure (Pa), $\rho o$: valve upstream air density ($kg/m^3$)

Figure 14:
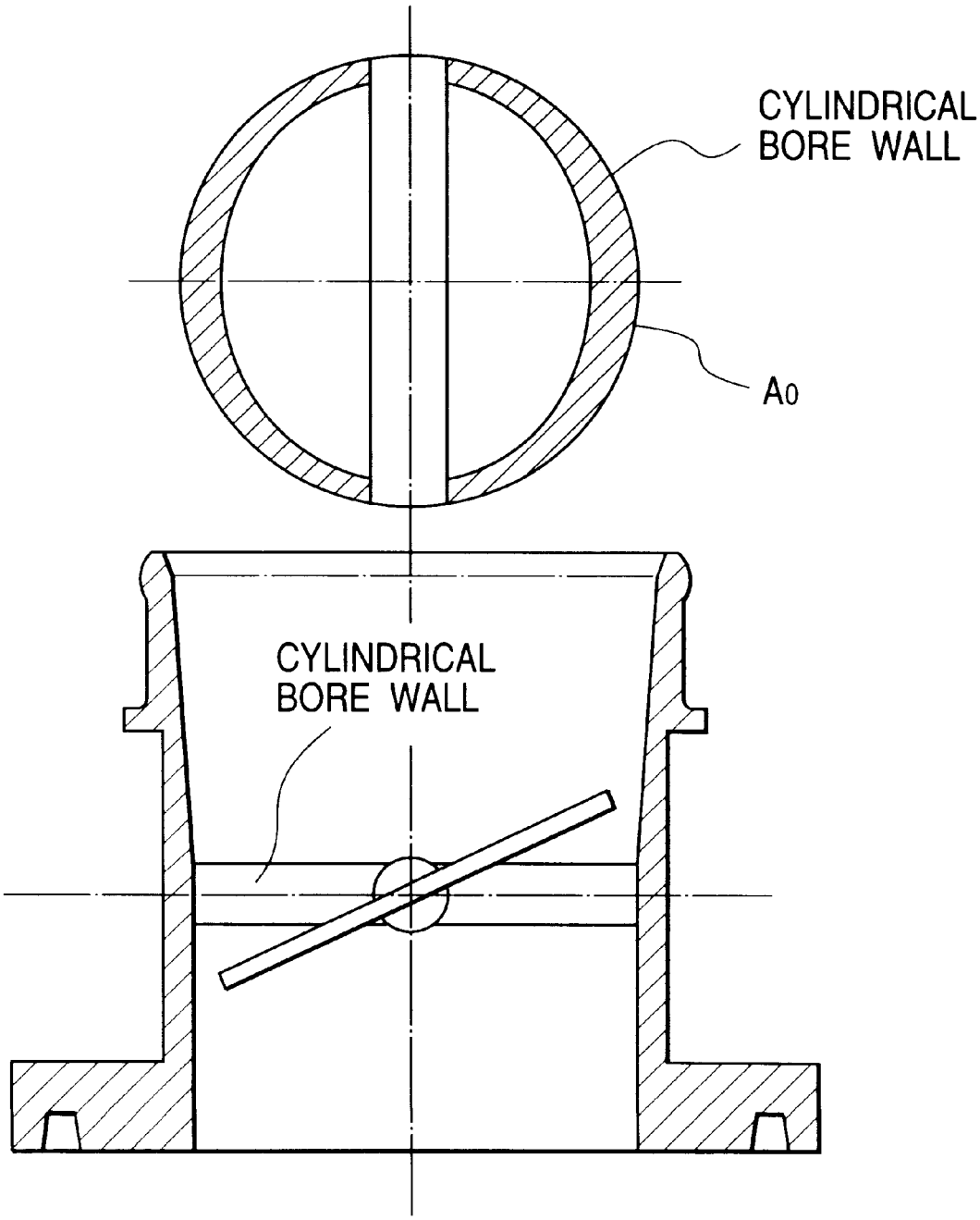
FIG. 14 is a view for describing an effective area of an intake passage defined by a body wall surface and a throttle valve within a conventional straight bore type throttle body.
Figure 15:
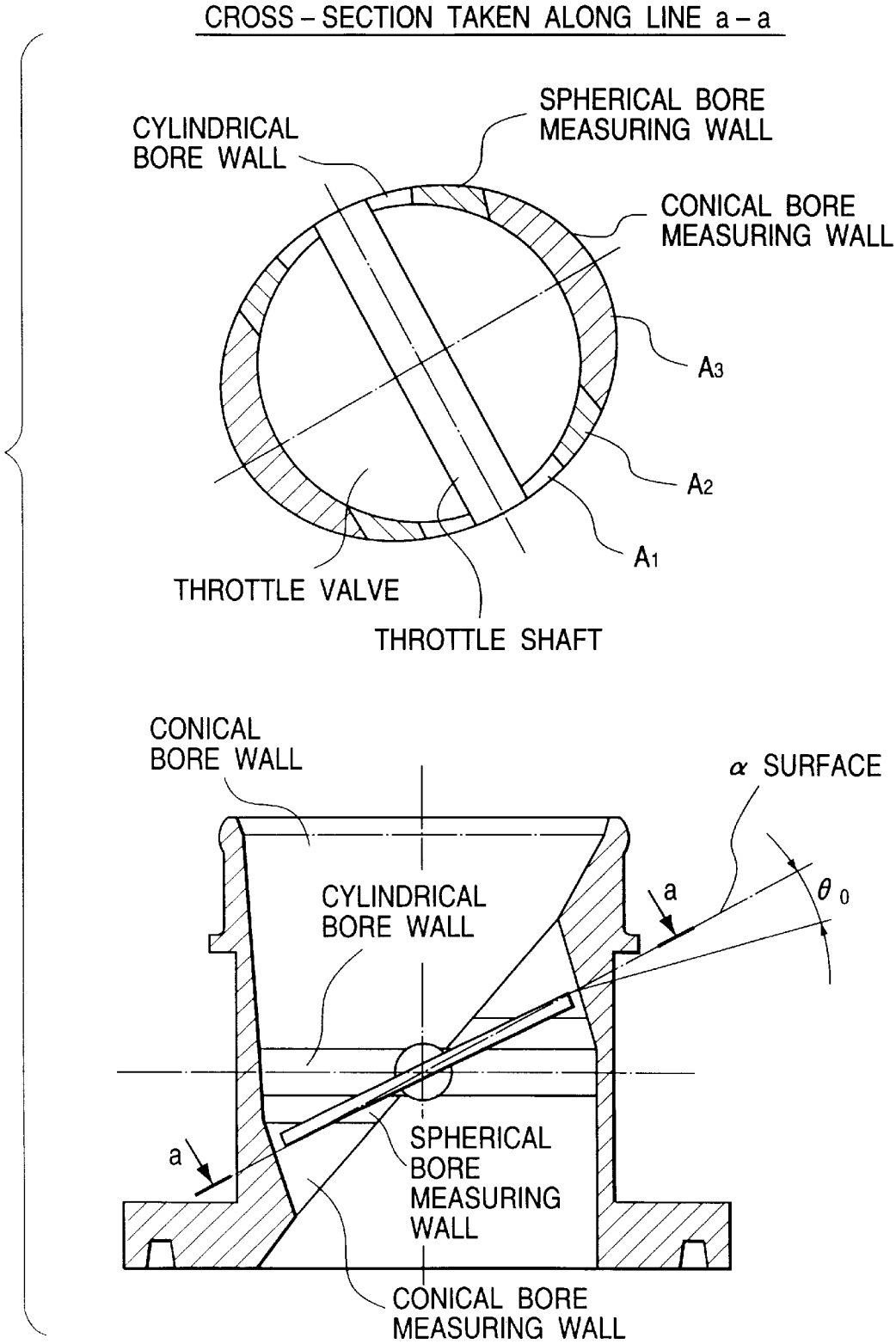
FIG. 15 is a view for describing an effective area of an intake passage defined within a throttle body constituting an embodiment of the present invention.

Now, effective areas of measuring intake passages for the straight bore and the respective spherical bores shown in FIGS. 9 through 12 are defined as shown in FIGS. 14 and 15.

Since air flows substantially along the cylindrical bore wall surface in the straight bore, the projected area of the intake passage as seen from the central direction of the cylindrical bore is represented as an effective area ($A=A_o$).

In the spherical bore, the flow of air does not depend on the edge of the curved-surface bore and the air is supposed to flow along the measuring wall surface. The effective area is represented by a projected area as seen from the direction of the normal to a $\alpha$ surface substantially orthogonal to the spherical bore wall. However, the angle formed by the conical bore wall and the normal to the $\alpha$ surface is given by $\theta_o$ and an effective area formed by the throttle valve and the conical bore measuring wall is represented as $A_3\cos\theta_o$.

In FIGS. 9 and 10, $A=A_1+A_2$. In FIGS. 11 and 12, $A=A_1+A_2+A_3\cos\theta_o$.

Figure 16:
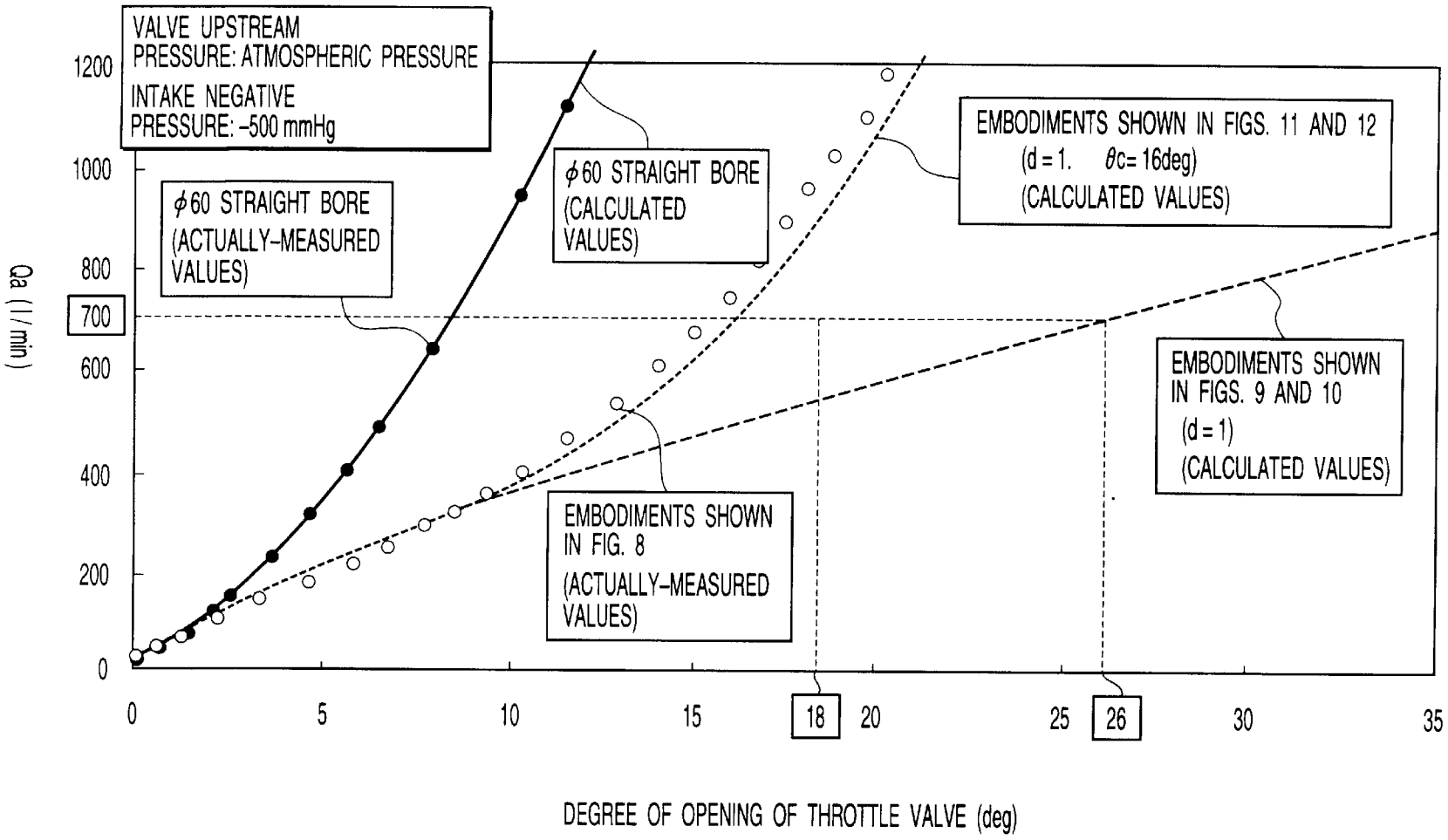
FIG. 16 is a view showing actually-measured values and desk-calculated values of changes in the degrees of opening of throttle valves and the quantities of intake air, which are employed in the conventional straight bore type throttle body and spherical bore type various embodiments each constituting the present invention.

In regard to the $\phi60$ straight bore, the spherical bore types (d=1) shown in FIGS. 9 and 10 and the spherical + conical bore types (d=1, $\theta=16°$) shown in FIGS. 11 and 12, the result of desk calculations of Qa and actually-measured values obtained in the $\phi60$ straight bore and the type A are shown in FIG. 16. The value of the flow coefficient C in the equation I is determined from an actually-measured value less than or equal to Qa 1000 L/min. in the $\phi60$ straight bore so as to determine C=0.89.

Figure 13:
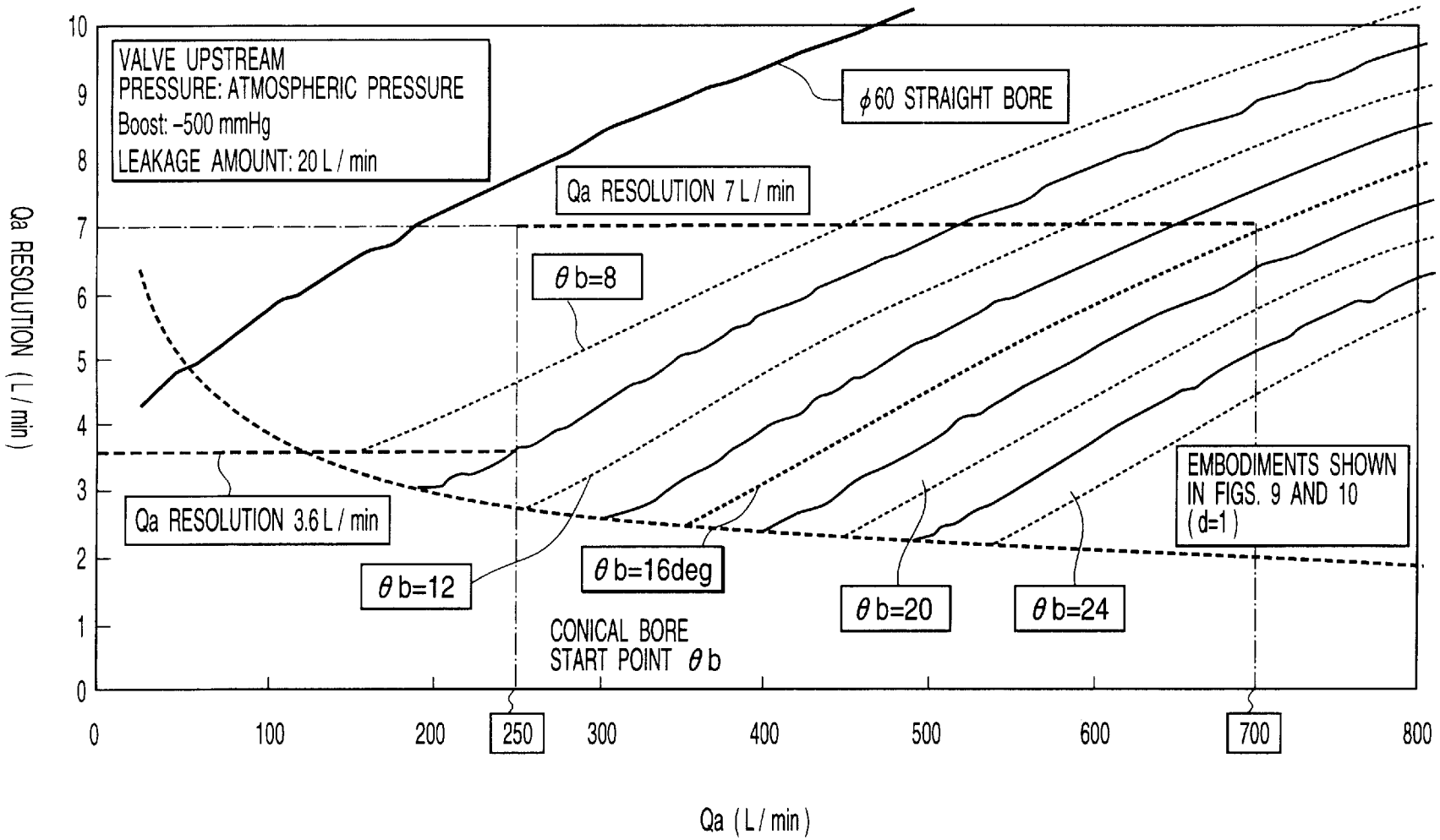
FIG. 13 is a view depicting intake air quantity (Qa) resolution characteristics of respective embodiments.

Although the types of FIGS. 9 and 10 in which the curved-surface bore shapes are represented as a double spherical surface, can be reduced in Qa resolution as compared with the type shown in FIG. 13, Qa characteristics are equal to characteristics convex upward. Therefore, Qa is considered to abruptly increase immediately after the throttle valve has come out of the spherical bore measuring wall.

On the other hand, the types shown in FIGS. 11 and 12 in which the measuring walls are changed from the spherical to conical surfaces, provide a small Qa increase and a smooth Qa increase even after the end of the throttle valve has approached the conical bore measuring wall (the neighborhood of 12 deg) as compared with one shown in FIG. 8 and are excellent in linkage of Qa as compared with ones shown in FIGS. 9 and 10. Therefore, the most suitable values of the amount of eccentricity d and the dimension of a conical bore start point Qb, which can achieve a target Qa resolution, were determined with ones shown in FIGS. 11 and 12 as objects.

Figure 17:
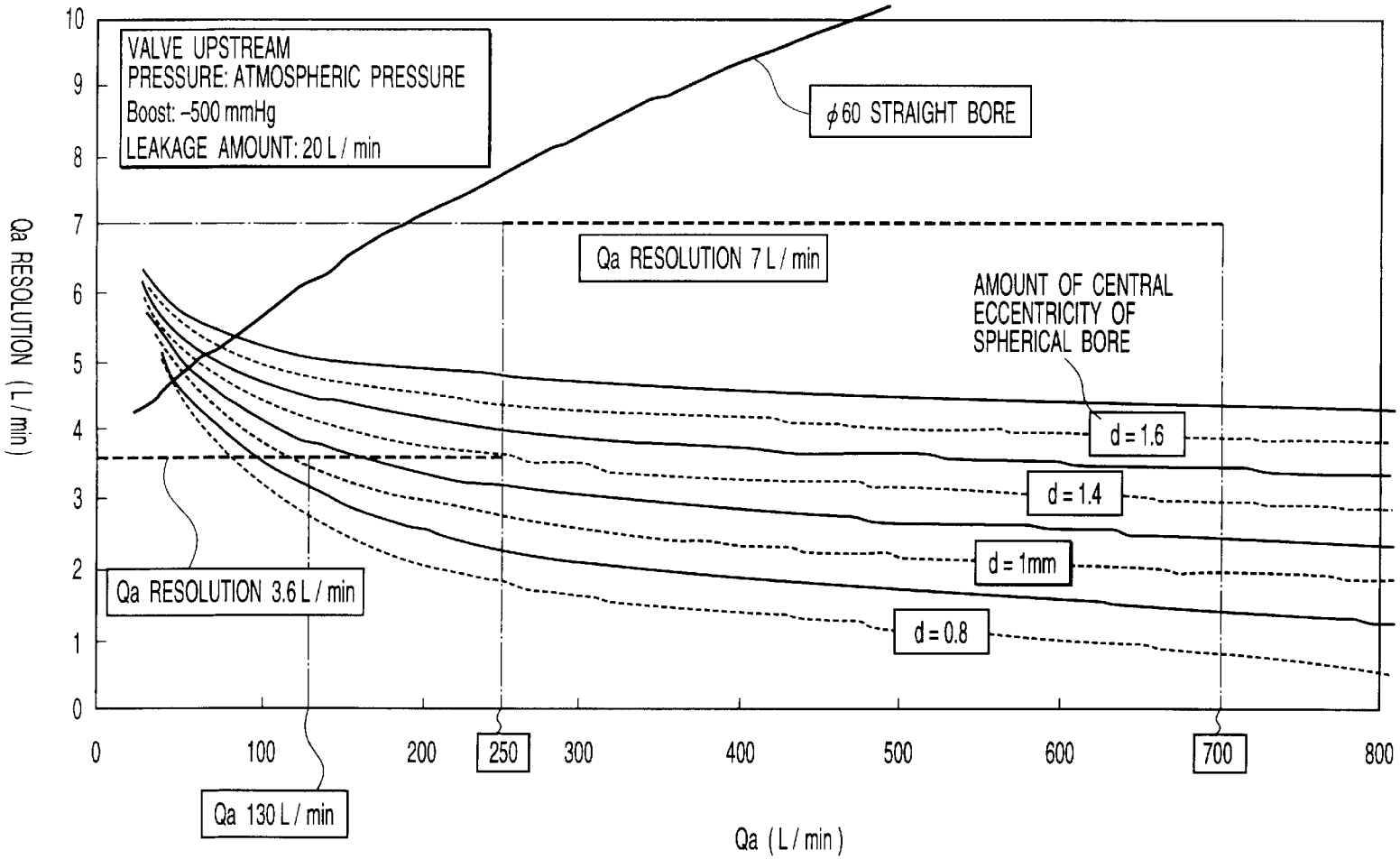
FIG. 17 is a view illustrating the result of calculations of Qa resolution characteristics with a start point of a conical bore measuring wall as a parameter.

The relationship between the Qa resolution and Qa in the spherical bore regions of the double spherical bore types shown in FIGS. 9 through 12 is shown in FIG. 17. A leakage amount 20 L/min. at the full closing of the throttle valve is added to a desk-calculated Qa. Qa in the spherical bore region does not depend on the value of the amount of eccentricity d and has a characteristic in which the Qa resolution decreases as Qa increases. As Qa decreases (becomes less than or equal to 100 L/min.), its value increases. In the vicinity of Qa=50 L/min., the Qa resolution reaches 3.6 L/min. or above. However, an electronically-controlled throttle in which ISC and FIC functions are intensively added to the throttle valve, can set high Qa passing through the throttle valve upon idling by a leakage amount of an intake devise. If the amount of eccentricity d is now determined assuming that 130 L/min. given with allowance from Qa=140 L/min. at the time that the number of revolutions of the engine at idle without a load is 600 r/min, is defined as a lower limit value, then the amount of eccentricity d that satisfies a Qa resolution of 3.6 L/min under Qa=250 L/min. or less, results in 1 mm or less. However, the amount of eccentricity d was set to 1 to reduce a pressure loss as low as possible.

The results obtained by calculating, for every conical bore start points $\theta b$, the relationship between the Qa resolution and Qa employed in the types shown in FIGS. 11 and 12 at the time that the amount of eccentricity d=1, will next be illustrated in FIG. 13. The cylindrical bore start point $\theta b$ satisfied on the basis of a target Qa resolution 3.6 L/min. or less at Qa less than or equal to 250 L/min. and a target Qa resolution 7 L/min. at Qa less than or equal to 700 L/min., is greater than 16 deg. However, $\theta b=16$ deg to reduce the pressure loss as low as possible.

Figure 19:
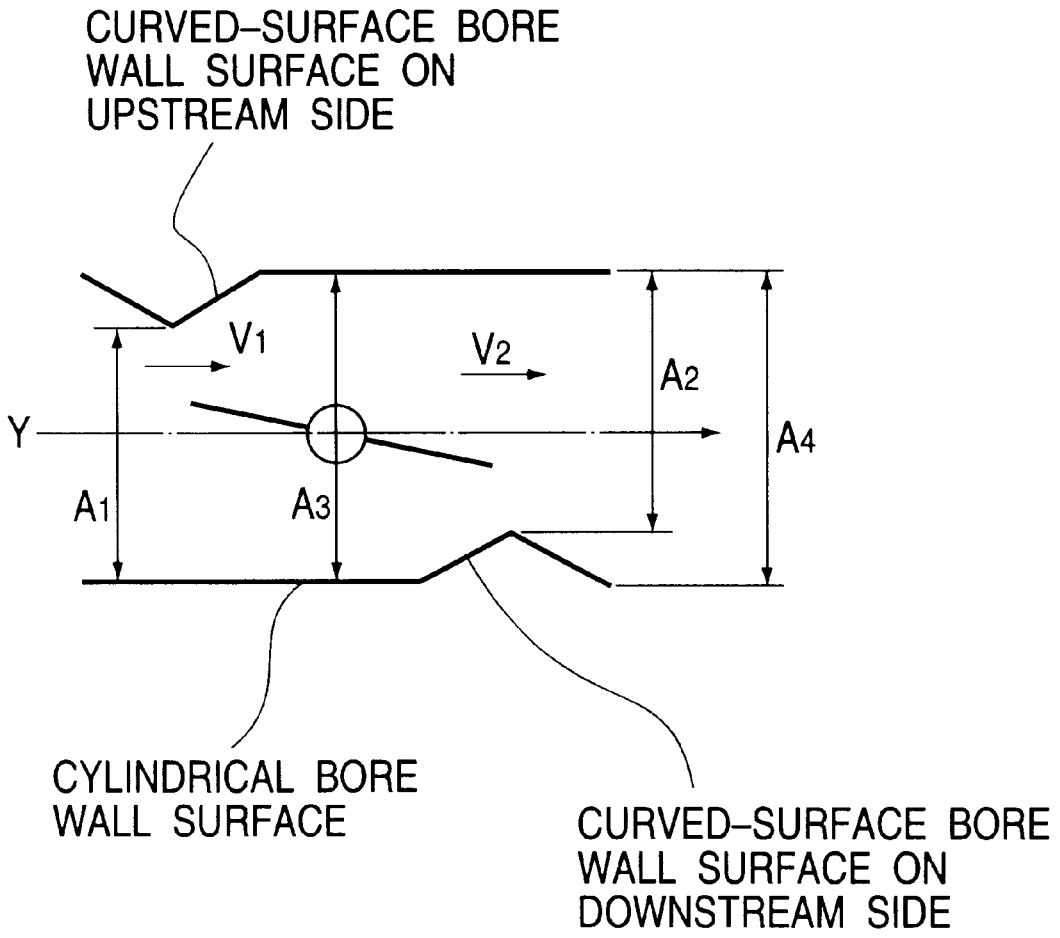
FIG. 19 is a view showing a model of an intake passage form.

The amount dP (mmHg) of an increase in pressure loss of the curved-surface bore with respect to the straight bore is determined assuming that the flow of air is produced under separation downstream from the edge portion. Namely, pressure losses produced in the respective embodiments were on-desk discussed by simulating the shape of an intake air passage on a simple basis as shown in FIG. 19. The pressure losses produced in reduced and enlarged passages are given by the following equations:

Amount of increase in pressure loss at curved-surface bore:

$$dP=dP_1+dP_2 \qquad \text{equation 2}$$

Amount of increase in pressure loss at curved-surface bore on the upstream side:

$$dP_1=\eta(1-A_1/A_3)^2V_1^2 \qquad \text{equation 3}$$

Amount of increase in pressure loss at curved-surface bore on the downstream side:

$$dP_2=\eta(1-A_2/A_4)^2V_2^2 \qquad \text{equation 4}$$

where $A_1$: projected area of curved-surface bore intake passage on the upstream side ($mm^2$)

$A_2$: projected area of curved-surface bore intake passage on the downstream side ($mm^2$)

$A_3$: area of intake passage in cylindrical bore portion ($mm^2$)

$A_4$: area of intake passage at bore downstream end ($mm^2$)

$V_1$: flow velocity at $A_1$ (m/s)

$V_2$: flow velocity at $A_2$ (m/s)

Figure 20:
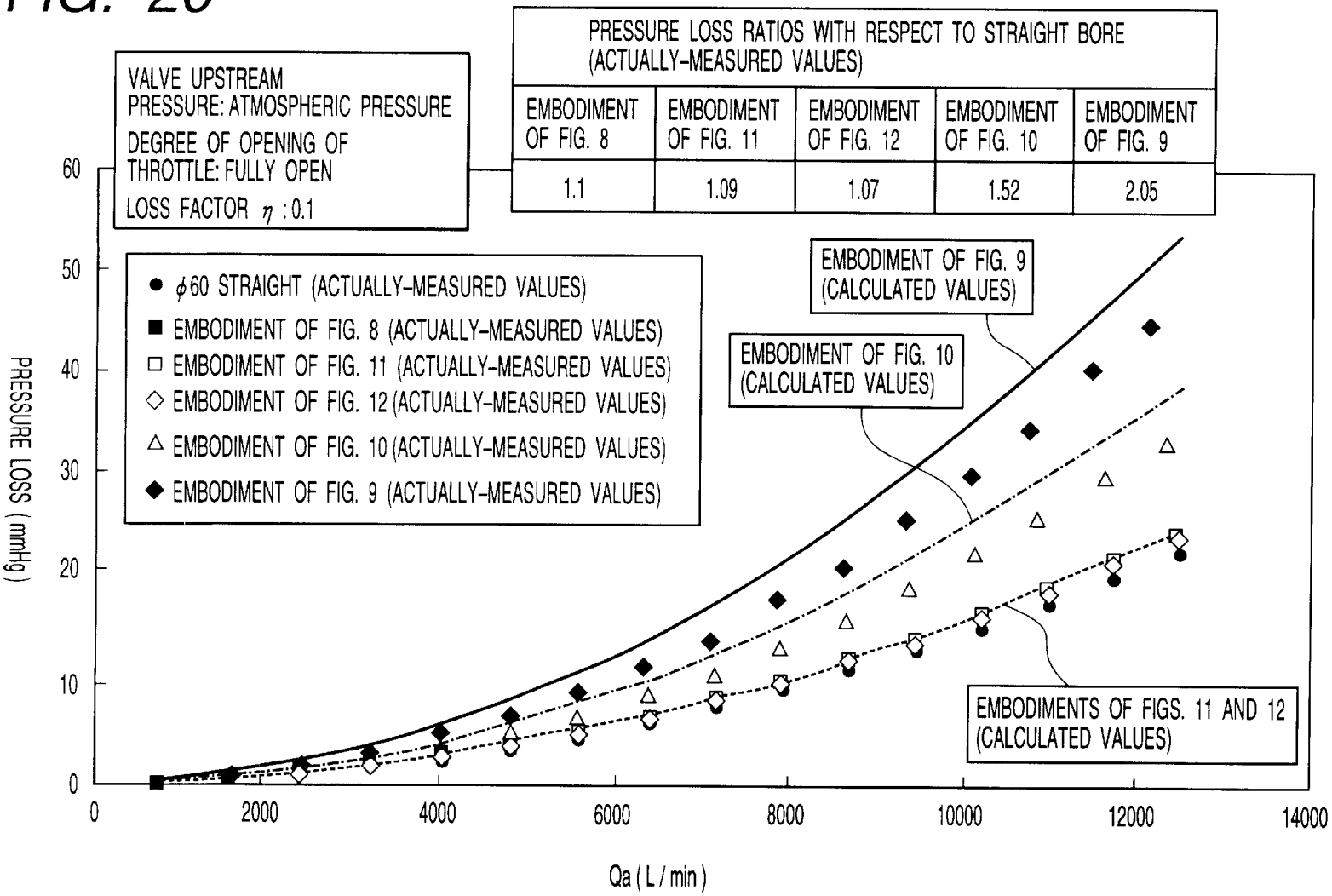
FIG. 20 is a view illustrating actually-measured values of pressure losses at the time that a throttle valve is fully opened.

The results of calculations of pressure losses with respect to Qa for the respective embodiments will be shown in FIG. 20. A loss factor $\eta$ is determined from the amount of the increase in pressure loss (actually-measured value) of the type shown in FIG. 8 with respect to the $\phi60$ straight bore. As a result, the loss factor $\eta$ is defined as equal to 0.1. Pressure loss ratios with respect to the $\phi60$ straight bore in the drawing are those obtained by comparing the results of calculation of pressure losses at the maximum intake air flow rate 10,500 L/min. at the time that the maximum speed of the engine is 7000 r/min. and the volumetric efficiency thereof is defined as 100%, with those for the $\phi60$ straight bore. They were shown for reference purposes.

It could be understood from the on-desk discussion that although the pressure loss ratios of the types shown in FIGS. 11 and 12 were substantially equivalent to that of the type shown in FIG. 8 and were problem-free levels, the embodiments of the types shown in FIGS. 9 and 10 were large in pressure loss as compared with the straight bore type and the type shown in FIG. 8 and the bore-shaped types shown in FIGS. 11 and 12 could be reduced in pressure loss.

Figure 18:
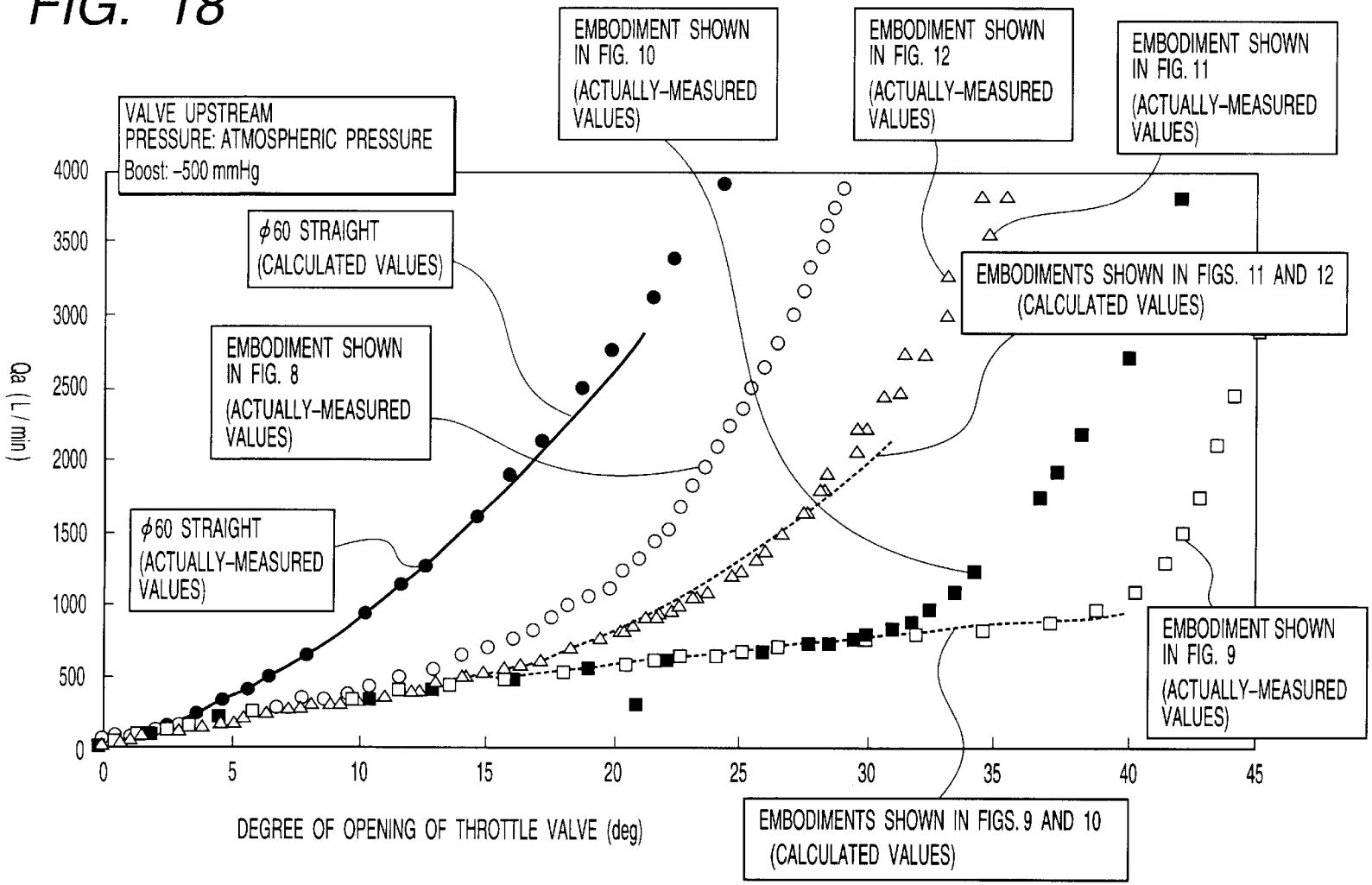
FIG. 18 is a view depicting Qa calculated values and actually-measured values obtained in the respective embodiments and the conventional example.

The results of measurements of Qa characteristics at Boost −500 mmHg with pressure upstream the valve as the atmospheric pressure will be shown in FIG. 18. In the embodiments of the types shown in FIGS. 9 and 10, Qa can be slowly increased by degrees to a high degree-of-opening as compared with other embodiments, whereas Qa abruptly increases in the neighborhood of the degree of opening at which the spherical bore measuring wall is terminated and the linkage of Qa from the low degree-of-opening to the high degree-of-opening is poor. On the other hand, the embodiments of the types shown in FIGS. 11 and 12 in which the measuring wall shape changes from the spherical shape to the conical shape, provide a small increase in Qa in a low degree-of-opening region and a smooth link of low to high degrees-of-opening as compared with the type shown in FIG. 8 and are excellent in linkage of Qa as compared with the types shown in FIGS. 9 and 10.

Figure 21:
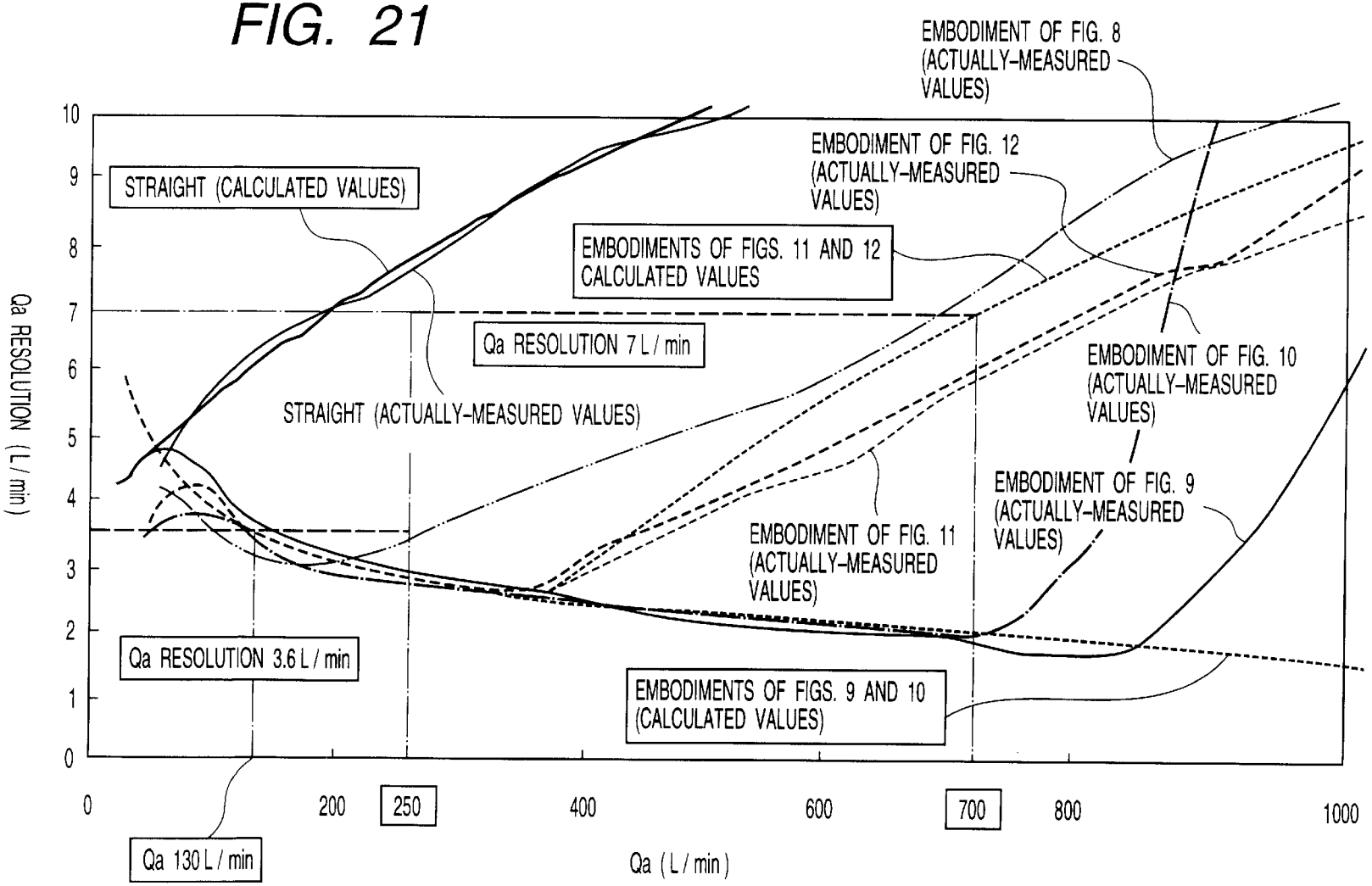
FIG. 21 is a view showing actually-measured values of Qa resolution.

The relationship between actually-measured values and calculated values of the Qa resolutions calculated from the Qa characteristic results for the types shown in FIGS. 8, 9, 10, 11 and 12 and the ϕ60 straight bore will be shown in FIG. 21.

It can be understood in the types shown in FIGS. 8 through 12 that any actually-measured values of those obtained in FIGS. 8 through 12 are substantially equal to the on-desk calculated values in tendency and the Qa resolution has reached a target value Qa resolution. In the types shown in FIGS. 11 and 12, the actually-measured value has a margin of about 1 L/min. with respect to the target value at Qa=700 L/min. Further, the pressure loss at the full opening of the throttle valve can be less reduced. It is also understood that the above types provide a satisfactory resolution of about 1 to 1.5 L/min. at Qa ranging from 400 L/min. to 700 L/min. as compared with the type shown in FIG. 8 and are high in Qa resolution as compared with the type shown in FIG. 8.

The results of pressure losses at the full opening of the throttle valve will be shown in FIG. 20. Results were obtained that the pressure losses produced in the embodiments shown in FIGS. 9 and 10 were greater than 1.5 times that for the ϕ60 straight bore, whereas the pressure losses produced in the embodiments shown in FIGS. 11 and 12 were substantially equal to the pressure loss produced in the embodiment shown in FIG. 8. It is understood that the embodiments shown in FIGS. 11 and 12 in which the bore measuring wall surface changes from the spherical bore wall surface to the conical bore wall surface, become effective against the pressure loss as compared with the embodiments shown in FIGS. 9 and 10 in which the measuring wall surface has been formed by the spherical bore wall surface alone. The result of on-desk discussions to the pressure loss is coincident in tendency with the result of actual measurements.

Next, resolutions (in which 3.6 liters/min. are defined as an upper limit value at less than or equal to 250 liters/min. and 7.0 liters/min. are defined as an upper limit value at greater than or equal to 250 liters/min.) of air quantities Qa employed in the respective embodiments shown in FIGS. 8, 10, 11 and 12 and actually-measured values of pressure loss ratios to the ϕ60 straight bore will be shown in Table 1.

TABLE 1

| | Target value | Embodiment of FIG. 8 | Embodiment of FIG. 11 | Embodiment of FIG. 12 | Embodiment of FIG. 10 |
|---|---|---|---|---|---|
| Qa resolution (Qa130~250 L/min) | 3.6 L/min or less | 3.4 L/min | 3.6 L/min | 3.6 L/min | 3.7 L/min |
| Qa resolution(Qa250~700 L/min) | 7.0 L/min or less | 7.2 L/min | 5.8 L/min | 6 L/min | 1.9 L/min |
| Pressure loss ratio to straight bore | similar to straight bore (once) | 1.10 times | 1.09 times | 1.07 times | 1.73 times |

From these results, (1) since the Qa resolutions employed in the embodiments shown in FIGS. 11 and 12 at Qa =250 L/min. to 700 L/min. are smaller by 1 L/min. than the upper limit 7 L/min. of the target Qa resolution, a conical bore start point Qa=16 deg can be further reduced so that the pressure loss at the full opening of the throttle valve can be kept small. (2) If reference is made to the Qa resolutions employed in the embodiments of FIGS. 11 and 12 shown in FIG. 13, then an error 1 L/min between calculated and actually-measured values of the Qa resolution is equivalent to a conical bore start point 3 deg and the target resolution can be achieved at θa=13 deg. (3) At this time, the maximum diameter of an edge cylindrical cut capable of ensuring Qa of 700 L/min with a conical bore measuring wall becomes ϕ56. (4) It could be understood that the pressure loss ratio (ϕ60 straight bore) at the full opening of the throttle valve of each of the types shown in FIGS. 11 and 12 wherein, based on equation 2 (loss factor η=0.08), the conical bore start point Qa=13 deg and the cylindrical cut diameter was defined as ϕ56, would result in 1.05 times.

As described above, the above data or characteristics were recognized as the most suitable shapes employed in the present embodiments.

Industrial Applicability

A throttle valve control device according to the present invention is an electrically-controlled throttle valve control device. The present invention is suitable for use in a throttle valve control device having no auxiliary device (such as an ISC valve device or the like) for controlling other air flow rate. However, the present invention is not necessarily limited to this. The present invention can be used even in a system (such as a system with a delay opening function) that needs to perform finer air quantity control at a low degree-of-opening portion. At this time, the present system has no bearing on whether or not a throttle valve is electrically controlled.

We claim:

1. A throttle valve control device for an internal combustion engine, comprising:

a throttle body forming a part of an intake air passage; and a throttle valve rotatably mounted in a bore of said throttle body;

said throttle body having a bore inner wall surface having curved-surface profiles each spherical or closely analogous to a spherical form in an idle control region located in the vicinity of a fully-closed angle of said throttle valve, said bore inner wall surface of said throttle body having, as regions following the curved-surface profiles spherical or closely analogous to the spherical form, regions each consisting of a curved-surface profile spherical or closely analogous to a spherical form and a composite surface profile of a surface substantially parallel to the flow of intake air, or regions each made up of a conical surface profile.

2. A throttle valve control device according to claim 1, wherein said surface substantially parallel to the flow of the intake air is a cylindrical surface.

3. A throttle valve control device according to claim 1, wherein the regions each consisting of the curved-surface profile spherical or closed analogous to the spherical form, and the regions each consisting of the curved-surface profile spherical or closely analogous to the spherical form and the composite surface profile of the surface substantially parallel to the flow of the intake air or the regions each consisting of the conical profile, are respectively provided symmetrically with respect to the upstream and downstream sides of said throttle valve.

4. A throttle valve control device according to claim 1, wherein the regions each consisting of the curved-surface profile spherical or closely analogous to the spherical form and the regions each consisting of the curved-surface profile spherical or closely analogous to the spherical form and the composite surface profile of the surface substantially parallel to the flow of the intake air or the regions each consisting of the conical profile, are respectively provided on one of the upstream and downstream sides of said throttle valve and, a conical surface profile is provided on the other of the upstream and downstream sides of said throttle valve.

5. A throttle valve control device according to claim 1, wherein the degree of opening of said throttle valve is less than or equal to 90°.

6. A throttle valve control device for an internal combustion engine, comprising:

a throttle body forming a part of an intake air passage; and a throttle valve rotatably mounted in a bore of said throttle body, said throttle body having a bore inner wall surface having curved-surface profiles each spherical or closely analogous to a spherical form in an idle control region located in the vicinity of a fully-closed angle of said throttle valve, said curved-surface profiles having central positions respectively placed in positions deviated toward the upstream and downstream sides along a central line of said bore by predetermined amounts from the center of rotation of said throttle valve, said bore of said throttle body including, as regions following the curved-surface shapes spherical or closely analogous to the spherical form, regions each consisting of a curved-surface profile spherical or closely analogous to a spherical form and a composite surface profile of a surface substantially parallel to the flow of intake air, or regions each made up of a conical surface profile.

7. A throttle valve control device for an internal combustion engine, comprising:

a throttle body forming a part of an intake passage; and a throttle valve rotatably mounted in a bore of said throttle body;

said throttle body having a bore inner wall surface including curved-surface profiles each spherical or closely analogous to a spherical form in an idle control region lying in the vicinity of a fully-closed angle of said throttle valve and one of regions on the upstream and downstream sides of said throttle valve, and conical surface profiles in the idle control region lying in the vicinity of the fully-closed angle of said throttle valve and the other of said regions on the upstream and downstream sides thereof, said curved-surface profiles each having a central position coincident with a point of intersection of the center of rotation of said throttle valve and the central line of said bore, said bore of said throttle body having, as regions following the curved-surface profiles spherical or closely analogous to the spherical form, regions each comprised of a curved-surface profile spherical or closely analogous to a spherical form and a composite surface profile of a surface substantially parallel to the flow of intake air or regions each consisting of a conical surface profile.

8. A throttle valve control device for an internal combustion engine, comprising:

a throttle body forming a part of an intake air passage; and a throttle valve rotatably mounted in a bore of said throttle body;

said throttle body having a bore inner wall surface including, conical surface profiles in an idle control region lying in the vicinity of a fully-closed angle of said throttle valve and one of regions on the upstream and downstream sides of said throttle valve;

curved-surface shapes each spherical or closely analogous to a spherical form in the idle control region lying in the vicinity of the fully-closed angle of said throttle valve and the other of the regions on the upstream and downstream sides thereof, said curved-surface shapes having central positions respectively placed in positions deviated toward the curved-surface profile sides along a central line of said bore by predetermined amounts from the center of rotation of said throttle valve, and regions each comprising a curved-surface shape spherical or closely analogous to a spherical form and a composite surface profile of a surfaces substantially parallel to the flow of intake air or regions each formed of a conical surface profile, as regions following the curved-surface profiles each spherical or closely analogous to the spherical form.

9. A throttle valve control device for an internal combustion engine, comprising:

a throttle body forming a part of an intake air passage; and a throttle valve rotatably mounted to said throttle body;

said throttle body having a bore defined therein so that the center of rotation of said throttle valve is placed on a central line of said bore, said bore of said throttle body having curved-surface profiles each spherical or closely analogous to a spherical form in an idle control region lying in the vicinity of a fully-closed angle of said throttle valve, said bore having partial shapes following the curved-surface profiles, which are formed by elliptic profiles surrounded by two circular arcs.

10. A throttle valve control device for an internal combustion engine, comprising:

a throttle body forming a part of an intake air passage;

a throttle valve rotatably mounted to said throttle body;

an actuator for rotating said throttle valve;

throttle degree-of-opening detecting means for detecting a degree of opening of said throttle valve turned by said actuator;

accelerator degree-of-opening detecting means for detecting the amount of depression of an accelerator pedal; and control means for controlling said actuator based on said detected amount of depression in such a manner that the degree of opening of said throttle valve detected by said throttle degree-of-opening detecting means reaches a predetermined value, said throttle body including a bore defined therein having curved-surface profiles each spherical or closely analogous to a spherical form in an idle control region lying in the vicinity of a fully-closed angle of said throttle valve, said bore having regions each comprising a curved-surface profile spherical or closely analogous to a spherical form and a composite surface profile of a surface substantially parallel to the flow of intake air, as regions following the curved-surface profiles each spherical or closely analogous to the spherical form.

11. A throttle valve control device for an internal combustion engine, said throttle valve control device being constructed so as to electrically detect the amount of depression of an accelerator pedal and allow an actuator to control the opening and closing of a throttle valve provided in an intake passage in response to the detected signal, wherein said actuator is constructed so as to allow said throttle valve to be opened or closed with an accuracy of 0.1° and a clearance defined between an inner wall surface of an intake pipe and the throttle valve is set such that a change in engine speed at the time that said throttle valve is open by 0.1°, is less than or equal to 20 rpm in an idle driving region of the engine.

12. A throttle valve control device for an internal combustion engine, wherein a clearance between a bore inner wall surface of a throttle body forming a part of an intake air passage and a throttle valve rotatably supported by said throttle valve so as to control a passage sectional area of a bore of said throttle body is defined in such a manner that a control resolution of an air flow rate is less than or equal to 7.0 liters/min./0.1 deg while an intake air flow rate ranges from 250 liters/min. to 700 liters/min. with respect to a change of 0.1 deg in the degree of opening of said throttle valve, whereas the control resolution of the air flow rate is less than or equal to 3.6 liters/min./0.1 deg while the intake air flow rate ranges from 130 liters/min. to 250 liters/min.

13. A throttle valve control device for an internal combustion engine, comprising:

a throttle body forming a part of an intake air passage; and a throttle valve rotatably mounted to said throttle body;

said throttle body having a bore defined therein so that the center of rotation of said throttle valve is placed on a central line of said bore, said bore having curved-surface profiles each spherical or closely analogous to a spherical form in an idle control region lying in the vicinity of a fully-closed angle of said throttle valve, said bore having bore wall surfaces following the curved-surface profiles, which include wall surface profiles each exhibiting the rate of change in passage sectional area, which is larger than the rate of change in passage sectional area in each of regions for said curved-surface profiles, said each wall surface profile being constructed so that the rate of change in passage sectional area thereof gradually increases.

* * * * *